US007044319B2

(12) United States Patent
Overholt et al.

(10) Patent No.: US 7,044,319 B2
(45) **Date of Patent: *May 16, 2006**

(54) COLLAPSIBLE CONTAINER

(75) Inventors: Trenton M. Overholt, Manhattan Beach, CA (US); William Patrick Apps, Alpharetta, GA (US); Gerald R. Koefelda, Hermosa Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 57 days.

This patent is subject to a terminal disclaimer.

(21) Appl. No.: 10/163,004

(22) Filed: Jun. 3, 2002

(65) Prior Publication Data

US 2002/0158067 A1 Oct. 31, 2002

Related U.S. Application Data

(63) Continuation of application No. 09/473,261, filed on Dec. 27, 1999, now Pat. No. 6,398,054.

(51) Int. Cl.
*B65D 6/18* (2006.01)

(52) U.S. Cl. ..... 220/7

(58) Field of Classification Search ..... 220/6, 220/7, 4.28, 1.5

See application file for complete search history.

(56) References Cited

U.S. PATENT DOCUMENTS

| | | | |
|---|---|---|---|
| 3,446,415 | A | 5/1969 | Bromley |
| 3,628,683 | A | 12/1971 | Friedrich et al. |
| 3,874,546 | A | 4/1975 | Sanders et al. |
| B513,789 | I5 | 2/1976 | Koen |
| 3,973,692 | A | 8/1976 | Cloyd |
| 4,005,795 | A | 2/1977 | Mikkelsen et al. |
| 4,044,910 | A | 8/1977 | Box |
| 4,049,284 | A | 9/1977 | Capper |
| 4,062,467 | A | 12/1977 | Friedrich |
| 4,081,099 | A | 3/1978 | Shead |
| 4,170,313 | A | 10/1979 | Caves et al. |
| 4,181,236 | A | 1/1980 | Prodel |
| 4,300,695 | A | 11/1981 | Hsu |
| 4,349,120 | A | 9/1982 | DiNardo |
| 4,591,065 | A | 5/1986 | Foy |
| 4,663,803 | A | 5/1987 | Gora |
| 4,674,647 | A | 6/1987 | Gyenge et al. |
| 4,693,386 | A | 9/1987 | Hughes et al. |
| 4,735,330 | A | 4/1988 | Hoss |
| 4,735,331 | A | 4/1988 | Keenan et al. |
| 4,741,032 | A | 4/1988 | Hampton |
| 4,765,480 | A | 8/1988 | Malmanger |
| 4,775,068 | A | 10/1988 | Reiland et al. |
| 4,776,457 | A | 10/1988 | Ferraroni |
| 4,781,300 | A | 11/1988 | Long |

(Continued)

FOREIGN PATENT DOCUMENTS

| | | |
|---|---|---|
| DE | 27 34 964 A1 | 2/1979 |

(Continued)

*Primary Examiner*—Stephen Castellano

(57) ABSTRACT

A collapsible container including a base having a first pair of opposed upstanding members and a second pair of opposed upstanding members, and also including a first pair of opposed side walls each pivotably attached to the base and orientable between an assembled position and a second position. Each of the first pair of opposed side walls has a recess which mates with and receives a corresponding one of the first pair of opposed upstanding members when in the assembled position. The container further receive a second pair of opposed side walls each pivotably attached to a corresponding one of the second pair of opposed upstanding members and also orientable between an assembled position and a second position.

22 Claims, 31 Drawing Sheets

U.S. PATENT DOCUMENTS

| | | | |
|---|---|---|---|
| 4,809,874 | A | 3/1989 | Pehr |
| 4,846,089 | A | 7/1989 | Cedergreen |
| 4,887,747 | A | 12/1989 | Ostrowsky et al. |
| D306,264 | S | 2/1990 | Malmanger |
| 4,917,255 | A | 4/1990 | Foy et al. |
| 4,923,079 | A | 5/1990 | Foy |
| 4,940,155 | A | 7/1990 | Hewson |
| 4,960,223 | A | 10/1990 | Chiang et al. |
| 4,967,927 | A | 11/1990 | Reiland et al. |
| 4,979,634 | A | 12/1990 | Begley |
| 5,038,953 | A | 8/1991 | Radar |
| 5,048,715 | A | 9/1991 | Wolff |
| 5,076,457 | A | 12/1991 | Marovskis |
| 5,114,037 | A | 5/1992 | Hillis et al. |
| 5,161,709 | A | 11/1992 | Oestreich, Jr. |
| 5,183,180 | A | 2/1993 | Hawkins et al. |
| 5,289,935 | A | 3/1994 | Hillis et al. |
| 5,328,048 | A | 7/1994 | Stein |
| 5,353,948 | A | 10/1994 | Lanoue et al. |
| 5,398,834 | A | 3/1995 | Umiker |
| 5,474,197 | A | 12/1995 | Hillis et al. |
| 5,474,200 | A | 12/1995 | Nicholson |
| 5,515,987 | A | 5/1996 | Jacques et al. |
| 5,588,549 | A | 12/1996 | Furtner |
| 5,622,276 | A | 4/1997 | Simmons |
| 5,632,392 | A | 5/1997 | Oh |
| 5,699,926 | A | 12/1997 | Jacques et al. |
| 5,720,405 | A * | 2/1998 | Karpisek ..... 220/6 |
| 5,746,342 | A | 5/1998 | Jacques et al. |
| 5,797,508 | A | 8/1998 | Loftus et al. |
| 5,829,617 | A | 11/1998 | Umiker |
| 5,850,936 | A | 12/1998 | Umiker |
| 5,853,099 | A | 12/1998 | Lessard |
| 5,988,420 | A | 11/1999 | Jacques et al. |
| 6,015,056 | A | 1/2000 | Overholt et al. |
| D423,217 | S | 4/2000 | Varfeldt |
| D424,299 | S | 5/2000 | Varfeldt |
| 6,098,827 | A | 8/2000 | Overholt et al. |
| 6,209,742 | B1 | 4/2001 | Overholt et al. |
| D446,392 | S | 8/2001 | Overholt et al. |
| 6,386,388 | B1 | 5/2002 | Overholt |
| 6,398,054 | B1 | 6/2002 | Overholt et al. |
| 6,405,888 | B1 | 6/2002 | Overholt et al. |
| 6,460,717 | B1 | 10/2002 | Smyers et al. |

FOREIGN PATENT DOCUMENTS

| | | |
|---|---|---|
| EP | 0 127 414 | 12/1984 |
| EP | 0 178211 A1 | 9/1985 |
| EP | 0 404041 A1 | 12/1990 |
| WO | WO 86/01182 | 2/1986 |
| WO | WO 97/15502 | 5/1997 |

* cited by examiner

COLLAPSIBLE CONTAINER

This invention is a continuation of Ser. No. 09/473,261 filed Dec. 27, 1999 now U.S. Pat. No. 6,398,054.

TECHNICAL FIELD

This invention relates to a multi-purpose collapsible container adapted for storing, transporting, and displaying produce items and other goods.

BACKGROUND ART

Collapsible containers and crates are commonly used to transport and store a variety of items. Such crates are typically formed of injection molded plastic and are frequently adapted to receive perishable food items, such as produce. When assembled, such containers are rectangular in shape, and have a flat base surrounded by four upstanding flat side panels which are joined to the flat base. When the containers are not in use, the collapsible feature of the containers allows the containers to be folded or otherwise reduced in size, thereby providing a desired compact size when storage space is minimal.

In such collapsible containers, side wall edges are normally joined in the corners. However, for an assembled container during use, this corner system results in a less rigid container due to the corners being subjected to torsional and other bending forces during use. Accordingly, the corners are commonly a focal point of stress in containers of this type.

Moreover, the base of the container is subject to a relatively large amount of load when the container is filled and may frequently be lacking in the area of stability and strength. Because these containers often stack on top of others or may have other loads exerted on their upstanding panels, the side panels may also require enhanced strength. Typically, when a rectangular container is collapsed inwardly, first the long walls are collapsed and then the short walls are collapsed on top of the long walls. Because there exists a gap between the short walls when folded, a container stacked thereupon is not fully supported in the area of the gap. Also, because one container rests upon the walls of another container, any transfer of top load forces is transferred through the walls, which may reduce the durability of the container. Other containers may fold the short walls first and the long walls second, but this configuration requires a reduced long wall height, because for ideal nesting conditions with other containers, the long walls in this type of container should not overlap when folded.

Further, containers are also shipped on pallets and are commonly strapped together to secure them during shipping and transport on the pallets. Such palletizing of the containers is often done automatically by machinery which may improperly position the straps, or subject the containers to unnecessary stress.

The improved container should be capable of stacking with similar containers when assembled and nested with similar containers when folded. The container should also have a sturdy construction and load-bearing properties. The container should avoid the durability concerns of nesting a container to rest solely on the walls of the container therebelow. The container should also accommodate the palletizing procedures when containers are strapped together.

DISCLOSURE OF INVENTION

It is an object of the present invention to provide a collapsible container which has improved strength and top loading stability.

Moreover, it is an object according to the present invention to provide a collapsible display container which is cost effective to manufacture and efficient to assemble.

Further, it is another object according to the present invention to provide a collapsible display container which is capable of nesting with the like containers when in a collapsed position, and is also capable of stacking with like containers when in the assembled position.

It is another object according to the present invention to provide a container that has a bottom which is robust and has a design which is sufficiently able to support the load placed therein.

It is still another object according to the present invention to provide a collapsible container which minimizes corner stress concentration.

It is yet a further object according to the present invention to provide a collapsible container which is adapted to be palletized and which is able to have improved durability during the placement of the pallet straps.

It is still further another object according to the present invention to provide a collapsible container which avoids the durability concerns of nesting a container to rest solely on the walls of the container therebelow, allowing it to nest on other portions of the container besides the walls.

In carrying out the above objects, features and advantages according to the present invention, provided is a collapsible container including a base having a first pair of opposed upstanding members and a second pair of opposed upstanding members, and also including a first pair of opposed side walls each pivotably attached to the base and orientable between an assembled position and a second position. Each of the first pair of opposed side walls has a recess which mates with and receives a corresponding one of the first pair of opposed upstanding members when in the assembled position. The container further receives a second pair of opposed side walls each pivotably attached to a corresponding one of the second pair of opposed upstanding members and also orientable between an assembled position and a second position. The base includes a first and second pair of opposed edges to which the first pair of opposed side walls and the second pair of opposed side walls are pivotably attached to a corresponding edge. When the first and second pair of opposed side walls are oriented in the second position, they are oriented in one of an inwardly folded orientation and an outwardly folded orientation.

In one embodiment, the base has a raised portion which extends between one of the first and second pairs of opposed side walls. The base may also include a plurality of upstanding corner members each having a recess formed therein for receiving a mating wall portion extending outwardly from the lateral edge of the first pair of opposed side walls, for enhancing the strength of the container. In another embodiment, the container may also include a plurality of recesses adapted to align and receive a palletizing strap therein. Each of the first pair of opposed side walls includes a latch member disposed thereon for latching the first and second pairs of opposed side walls when oriented in the assembled position. Accordingly, each of the second pair of opposed side walls includes a pair of opposed lateral flanges inwardly depending therefrom and formed integral therewith, the lateral flange having a latch receiver formed therein. The latch receiver also includes an aperture and a flexible latch spring member which has a latch release member actuable by a user.

According to the present invention, when the container is in assembled position and the second position, each lateral flange of the second pair of opposed side walls is substantially co-planar with the first pair of upstanding opposed members of the base. The first pair of opposed side walls includes a pair of opposed lateral edges, each lateral edge having a latching member attached thereto, such that when the container is oriented in an assembled position, each lateral flange abuts an adjacent lateral edge so that each aperture receives a corresponding latching member which is fastened into position by the latch spring member. This forms a secure attachment between the first and second pairs of opposed side walls. To return the container to a collapsed position from the assembled position, each latch release member is actuated by the user in order to release the latching member fastened therein. Preferably, the pairs of opposed upstanding members are centrally disposed along the length of the base. The pair of opposed upstanding members have a polygonal shape, and may particularly have a trapezoidal shape.

In another embodiment according to the present invention, the collapsible container is orientable in an inwardly folded position and is adapted to receive the base of at least one other container thereupon in a nesting orientation when the collapsible container is in the inwardly folded position. This collapsible container includes a base which has an upper surface and a pair of opposed upstanding members. Also included are a first pair of opposed side walls which are each pivotably attached to the base and orientable in the inwardly folded position such that they are disposed adjacent the upper surface of the base. A second pair of opposed side walls are each pivotably attached to the base and are orientable in the inwardly folded position for resting on the first pair of opposed side walls. The second pair of opposed side walls when inwardly folded position are spaced apart with the pair of opposed upstanding members disposed therebetween. Thus, in the inwardly folded orientation, the second pair of opposed side walls and an upper surface of the opposed upstanding members are co-planar to provide a stable surface for nesting the at least one other container thereupon. This other container may preferably be a container similar to but half the size of the lower container. The pair of opposed upstanding members are centrally disposed along the length of the base.

In yet another embodiment, a collapsible container is provided which is orientable between an assembled position and a collapsed position and is also adapted to be secured to a pallet. The container includes a base, a pair of opposed first side walls pivotably attached to the base, and a pair of second opposed side walls pivotably attached to the base and releasably attached to the pair of opposed first side walls. The pair of second opposed side walls have a pair of opposed inwardly directed flanges which when in the assembled position define corner wall portions. Each of the corner wall portions having a recess formed therein for receiving and aligning pallet straps therein which secure the container to a similar container.

In still another embodiment according to the present invention, provided is a collapsible container which includes a base which has a plurality of upstanding corner members each having a recess formed therein. Also included is a first pair of opposed side walls each having a pair of opposed lateral edges each having a linear portion and a second portion extending outwardly from beyond the linear portion. The second portion is received within a mating and corresponding recess of the upstanding corner members for enhancing the strength of the container.

In still further another embodiment keeping with the present invention, a collapsible container is provided which includes a base which has a first and second pairs of opposed edges. One of the first and second pairs of opposed edges is defined by an upstanding base wall. The other of the first and second pairs of opposed edges has an upstanding member. Each of the first and second pairs of opposed edges includes a plurality of lower hinge members. Also included is a first pair of opposed side walls, each having a plurality of upper hinge members for pivotably mounting to a corresponding one of the plurality of lower hinge members of the first pair of opposed edges. At least one of the first pair of opposed side walls includes a display member which is mounted thereto and which is movable between an open position and a closed position. Further included is a second pair of opposed side walls each releasably attached to the first pair of opposed side walls and each having a plurality of upper hinge members for pivotably mounting to a corresponding one of the plurality of lower hinge members of the second pair of opposed edges. The upper hinge members and the lower hinge members are pivotably mounted for moving the first and second pairs of opposed side walls between an up position and a down position. Also, one of the first and second pairs of opposed side walls includes a recessed portion for receiving therein a corresponding upstanding member when the container is oriented in the assembled position.

A method of nesting collapsible containers is provided according to the present invention and includes providing a collapsible container having a base with a first and second pair of opposed edges and a pair of centrally disposed upstanding members integrally formed with the first pair of opposed edges. The provided collapsible container further includes a first pair of opposed side walls pivotably attached to the first pair of opposed edges, and a second pair of opposed side walls pivotably attached to the second pair of opposed side walls. The method also includes folding inwardly the first pair of opposed side walls such that they are disposed adjacent the base upper surface, and folding inwardly the second pair of opposed side walls such that the first pair of opposed side walls are sandwiched between the base and the second pair of opposed side walls. Also included is positioning at least one other container on top of the inwardly folded collapsible container for nesting therewith.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
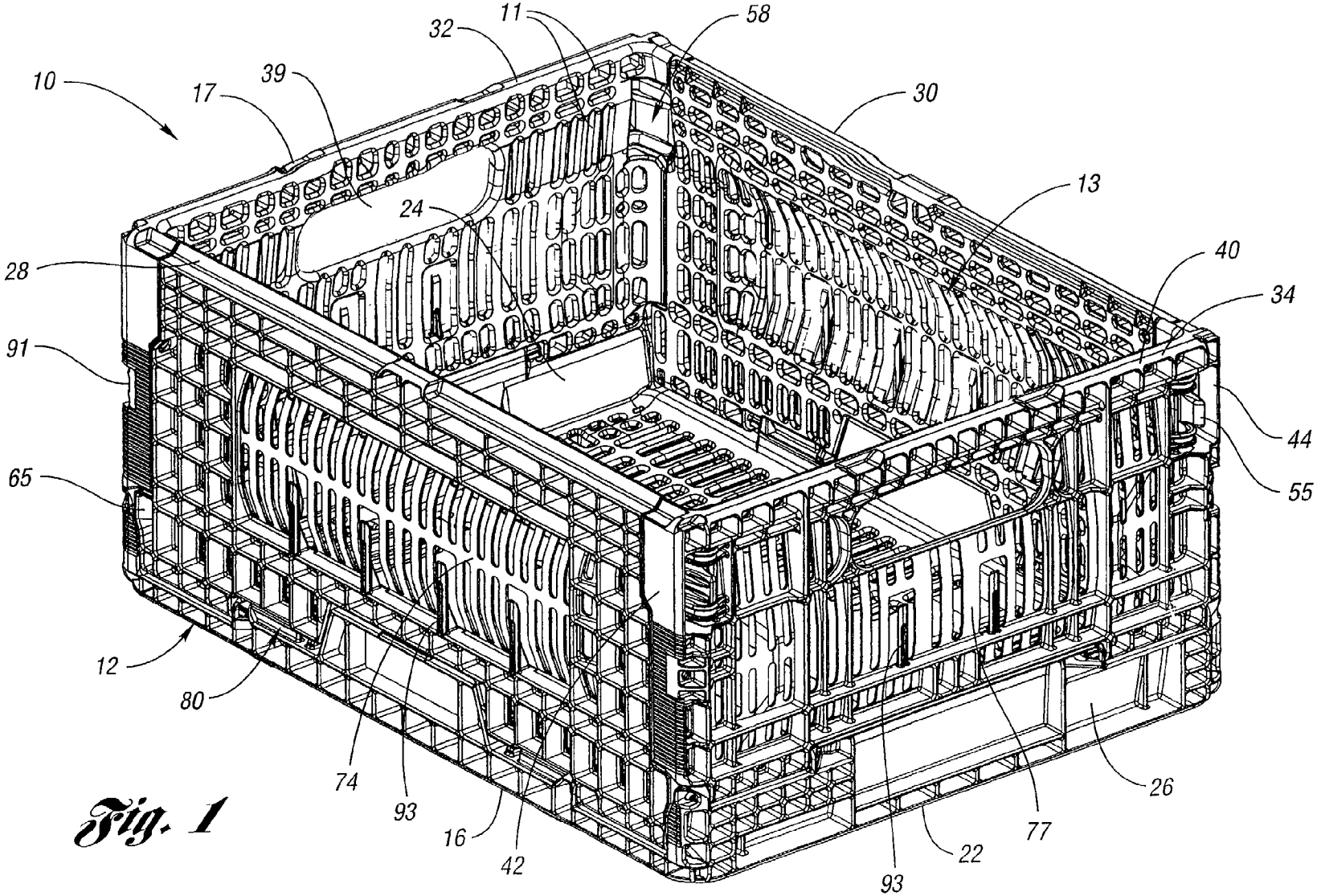
FIG. 1 of the drawings illustrates a perspective view of the collapsible container according to the present invention oriented in an assembled state.

With reference to FIG. 1 of the drawings, illustrated therein is collapsible container 10 according to the present invention in an assembled orientation or state. The components of container 10 are typically formed of various types of plastic or polymeric material by an injection molding or other plastic molding process suitable to this application. Container 10 may be used for the storage and transport of goods, and may also be referred to as a collapsible crate. While container 10 is suited for many uses, container 10 is particularly suitable for storing and transporting produce such as fruits and vegetables, where circulation of air and/or refrigerated gas is necessary to keep the produce fresh and consumable while it reaches the market. This circulation is fostered through the plurality of apertures 11 and other openings provided in base 12 and walls 28, 30, 32, 34 over the entire container 10. Container 10 is generally symmetrical around both its longitudinal and transverse centerlines.

Figure 5:
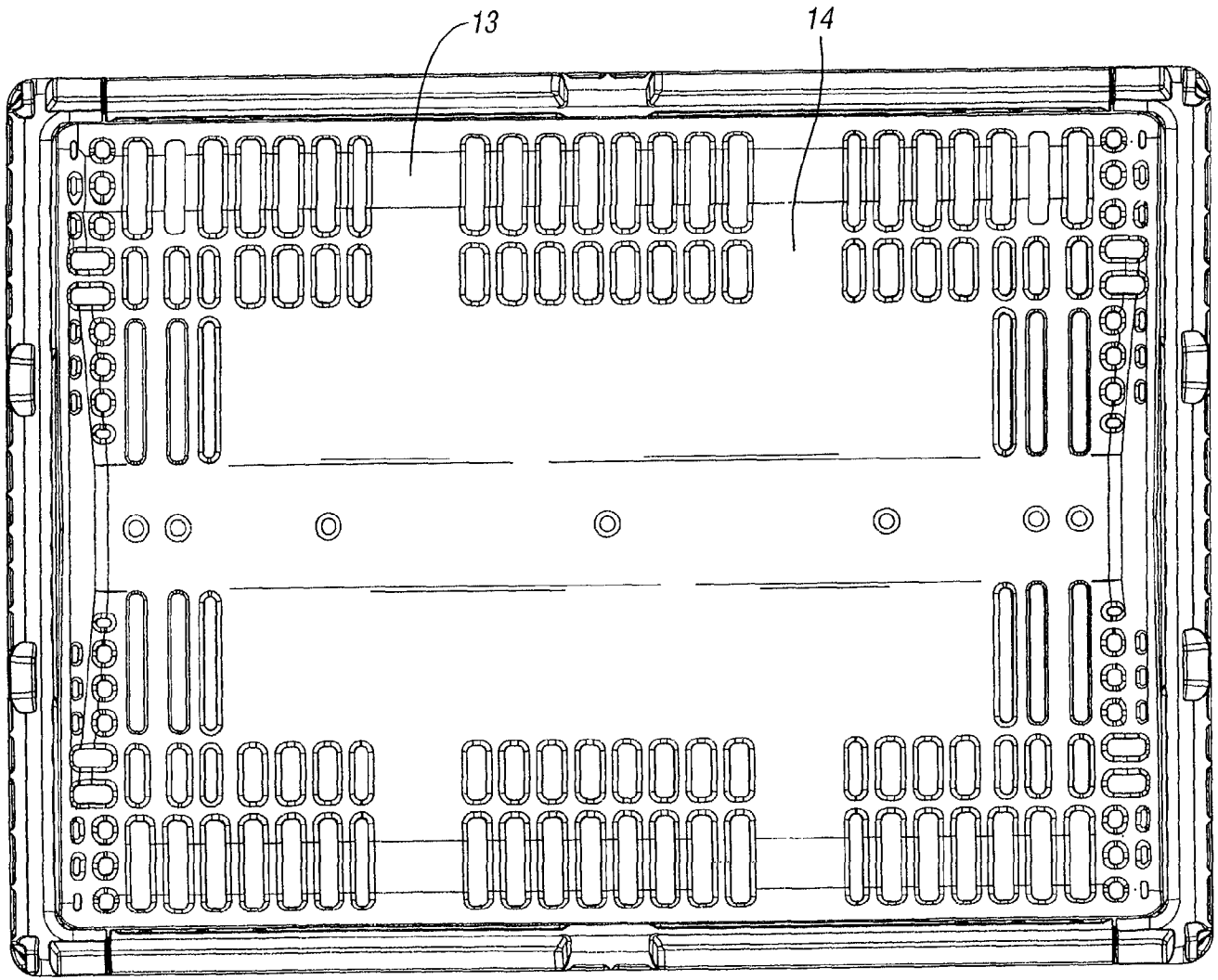
FIG. 5 illustrates a top plan view of the container of FIG. 1.
Figure 6:
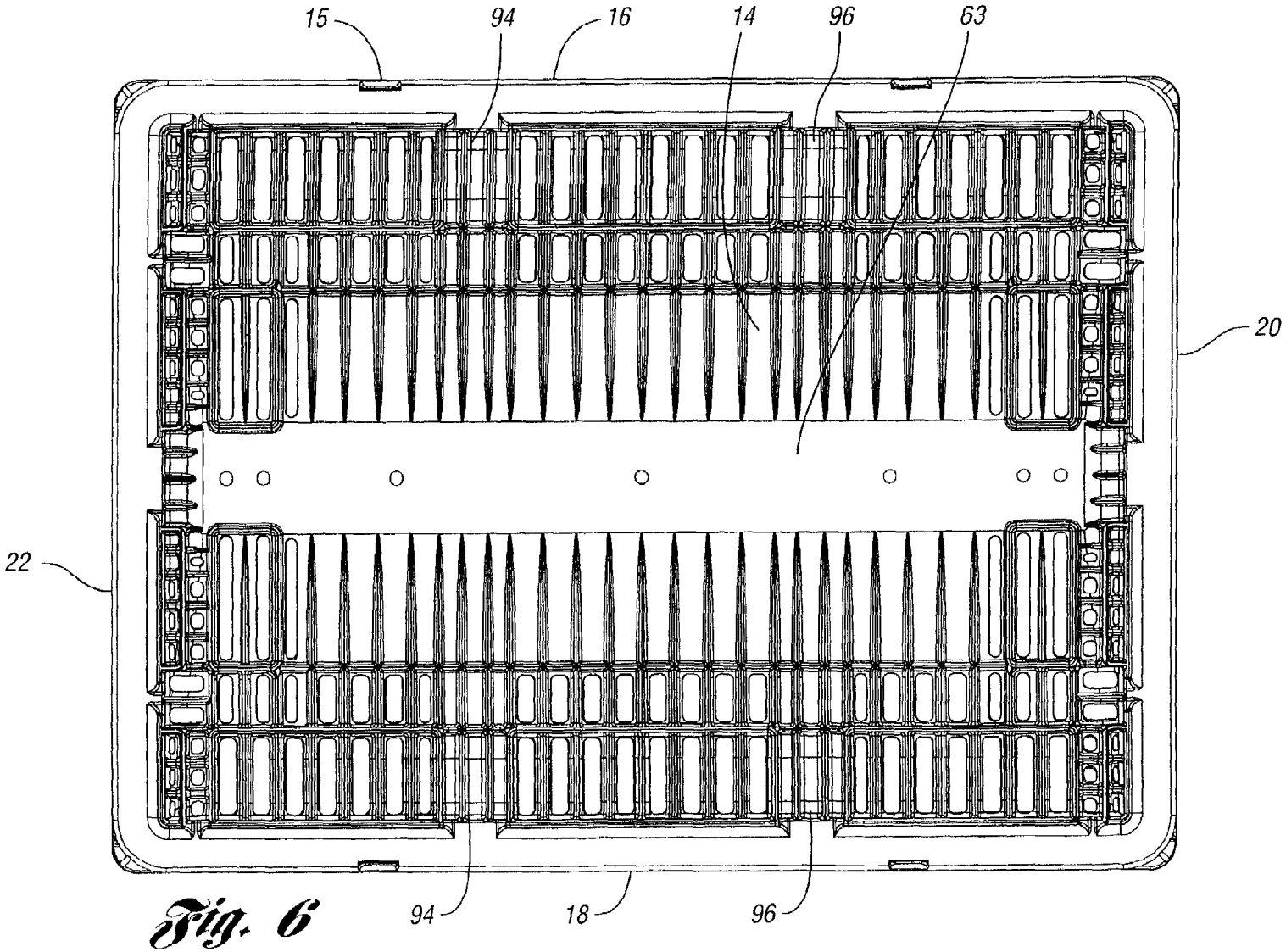
FIG. 6 is a bottom plan view of the container of FIG. 1.

Container 10 includes a base member 12 having a bottom panel 14 which serves as the lower support for the container. Base 12 is best illustrated in the bottom perspective view of FIG. 2 and the base perspective view of FIG. 7. As is best shown in the top plan view of FIG. 5 and bottom plan view of FIG. 6, bottom panel 14 is generally rectangular in shape. With further reference to FIGS. 1 and 6, bottom panel 14 has four edges—namely, a pair of opposed side edges 16 and 18, and a pair of opposed end edges 20 and 22. Base 12 further includes a pair of integrally molded opposed upstanding flanges 24 and 26 (or base walls) oriented perpendicular to bottom panel 14, each defining an upper end edge 25, 27, respectively. As is well understood in the art, the wall thickness of each of the walls and components illustrated and disclosed herein may vary depending on the intended usage and other characteristics desired from container 10.

Figure 2:
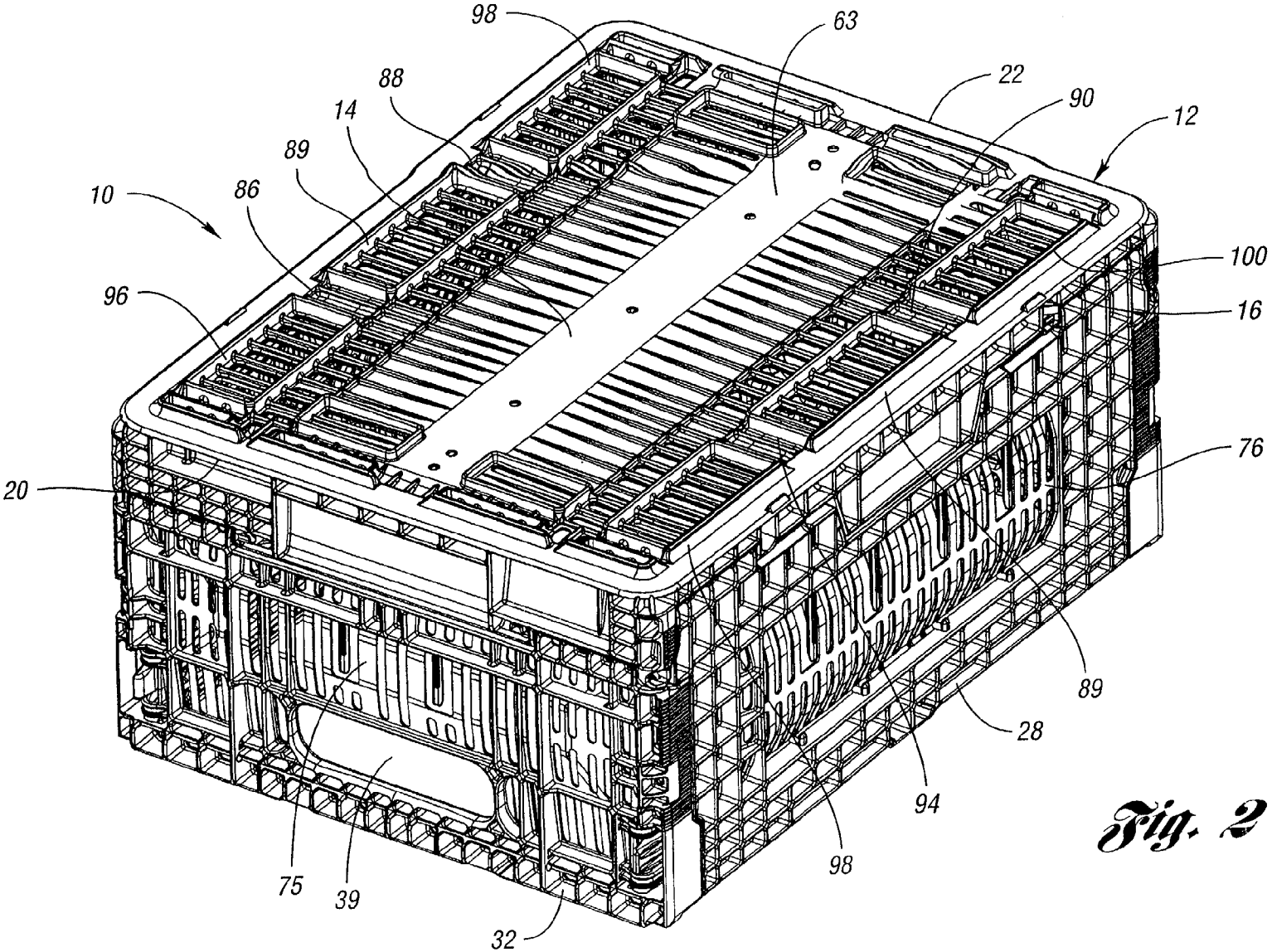
FIG. 2 is a bottom perspective view of the container of FIG. 1 oriented in the assembled state.
Figure 7:
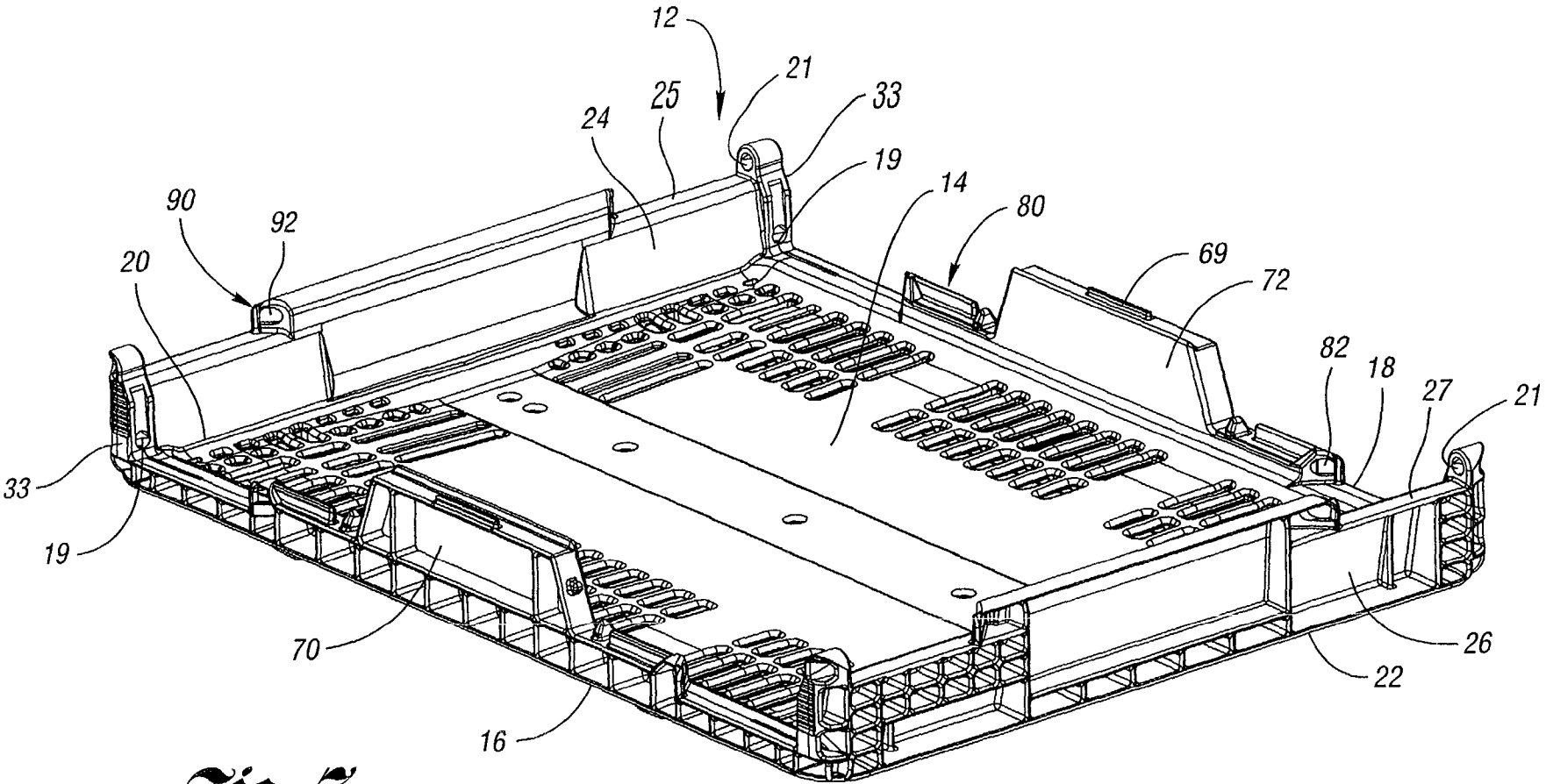
FIG. 7 illustrates a perspective view of the base of the container of FIG. 1.
Figure 14:
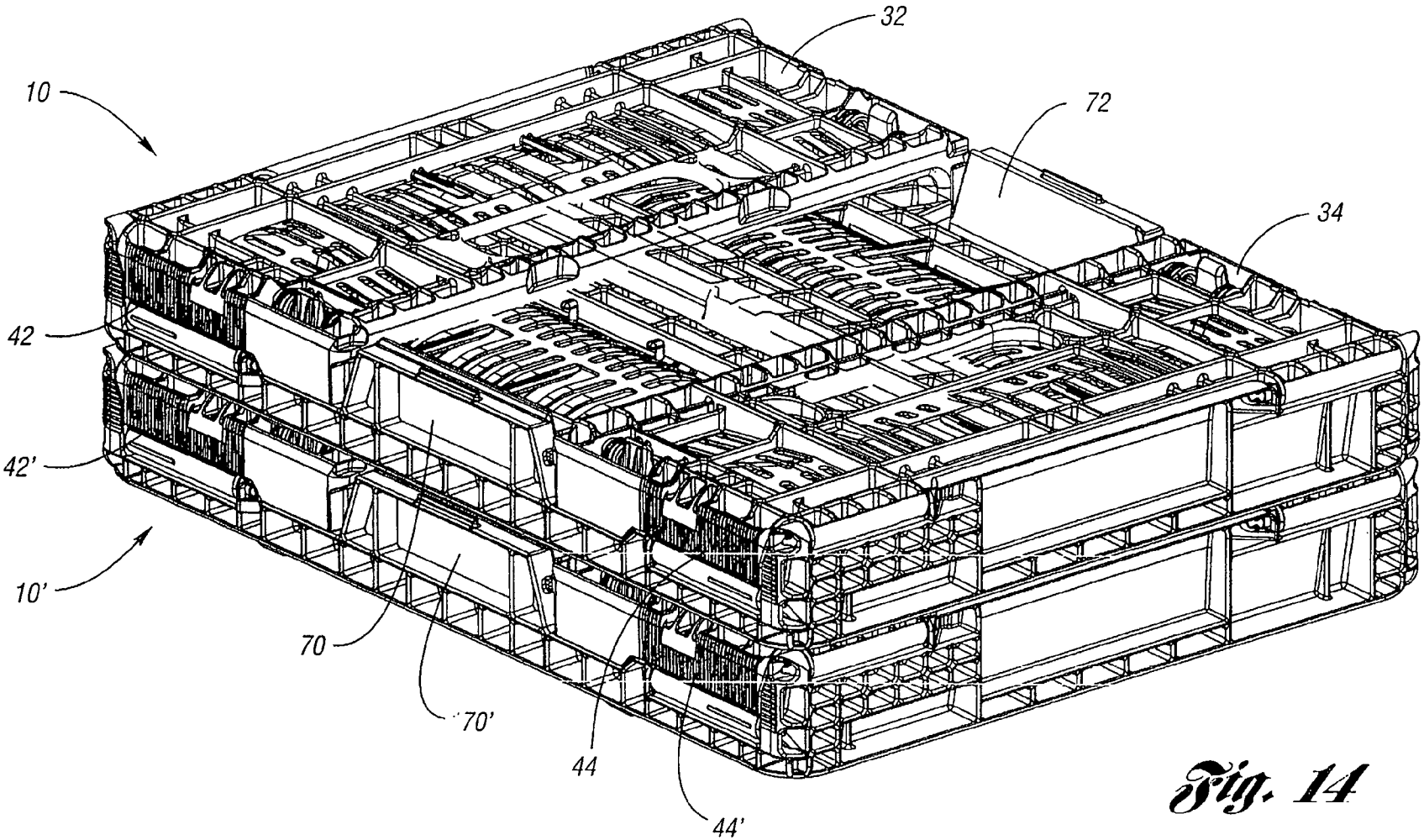
FIG. 14 is a perspective view of the container in an inwardly folded state as shown in FIG. 7, and which is stacked together in a stacked orientation with a like inwardly folded container.

As further illustrated in FIGS. 1, 2, and 7, base 12 also includes another pair of opposed upstanding members 70 and 72, which are integrally formed with bottom panel 14 at pair of opposed side edges 16, 18. While members 70, 72 are shown as having a substantially trapezoidal shape, it is contemplated that any number of shapes may be applicable and feasible according to the teachings of the present invention. Preferably, upstanding members 70, 72 are centrally located along the length of side edge 16, 18. Members 70, 72 provide additional structural and torsional stability to container 10 when in the assembled orientation of FIG. 1. Members 70, 72 also provide structural stability to one or more containers 10 which are nested (or stacked) together when in the inwardly folded position, as in FIGS. 11 and 14. In the orientation of FIG. 14, the lower container 10' is inwardly folded for receiving another container 10 thereupon (whether upper container 10 is folded or assembled).

Thus, in this orientation, members 70', 72' receive at least a portion of the top load from container 10, thereby allowing the top load from container 10 to be transferred directly to base 12' through members 70, 72. Without members 70', 72' the top load would otherwise be transferred to the lower container through the side walls, potentially reducing the durability and strength of the side walls.

Moreover, members 70, 72 also allow for increased display area for providing labels or other markings on container 10, which signify for example the contents of the container, the manufacturer, etc. Members 70, 72 also includes a raised portion or detent 69 disposed on its upper edge which provides a slight interference between base 12 and side walls 28, 30, such that when the side walls are moving between the collapsed state and the assembled state, the walls do not fall freely but necessitate user assistance, thereby allowing the user to assemble and disassembled the container without having to manipulate and balance all of the walls simultaneously.

As shown in FIGS. 1–2 and 10–12, container 10 also includes a first pair of opposed side walls 28 and 30, which are disposed opposite each other across bottom panel 14, and a second pair of opposed side walls 32, 34 disposed opposite each other. When in the assembled orientation of FIG. 1, first and second pairs of opposed side walls and base 12 define a compartment 13 for storing goods therein.

Figure 8:
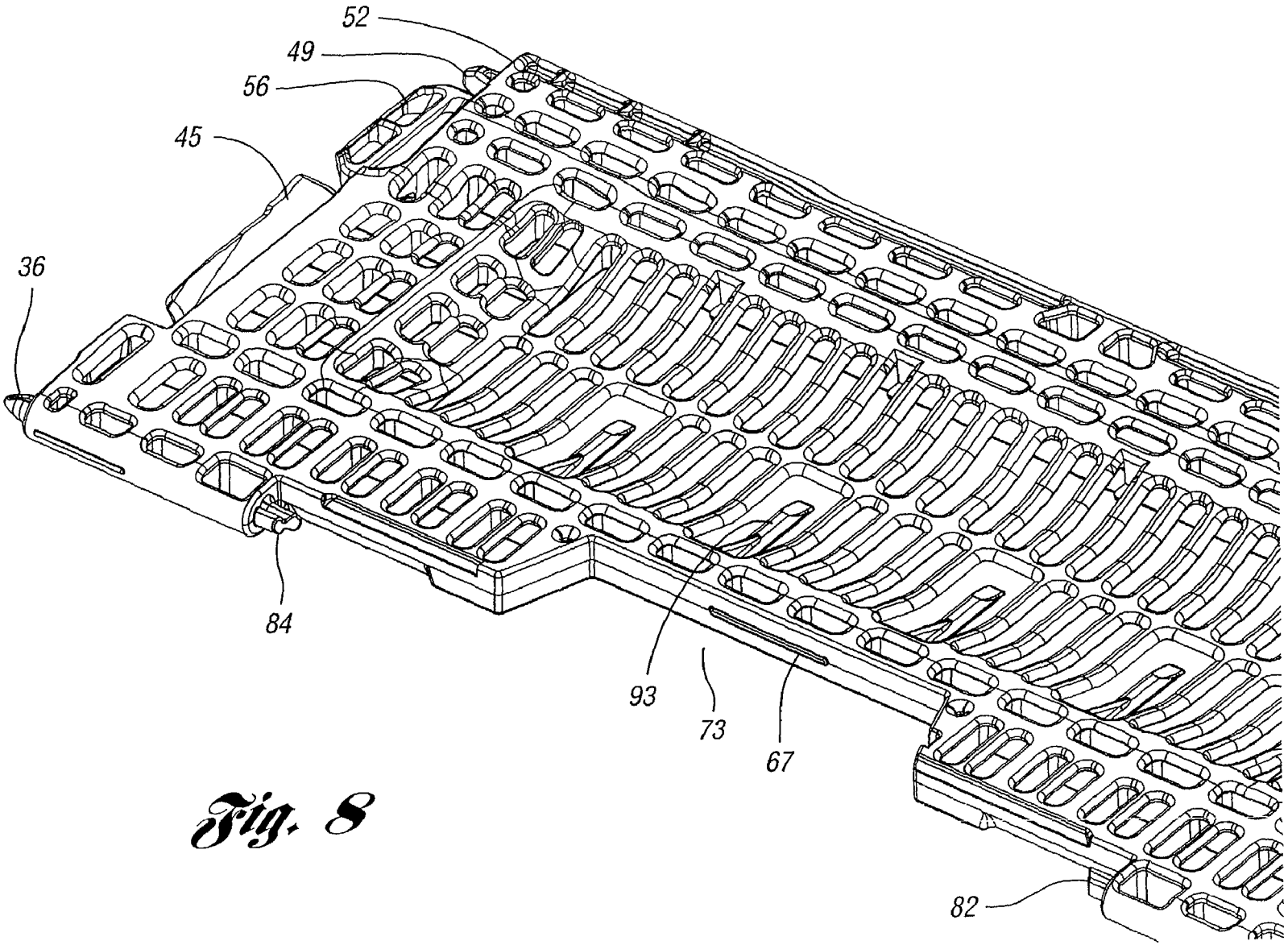
FIG. 8 is a partial perspective view of a side wall of the container of FIG. 1.
Figure 10:
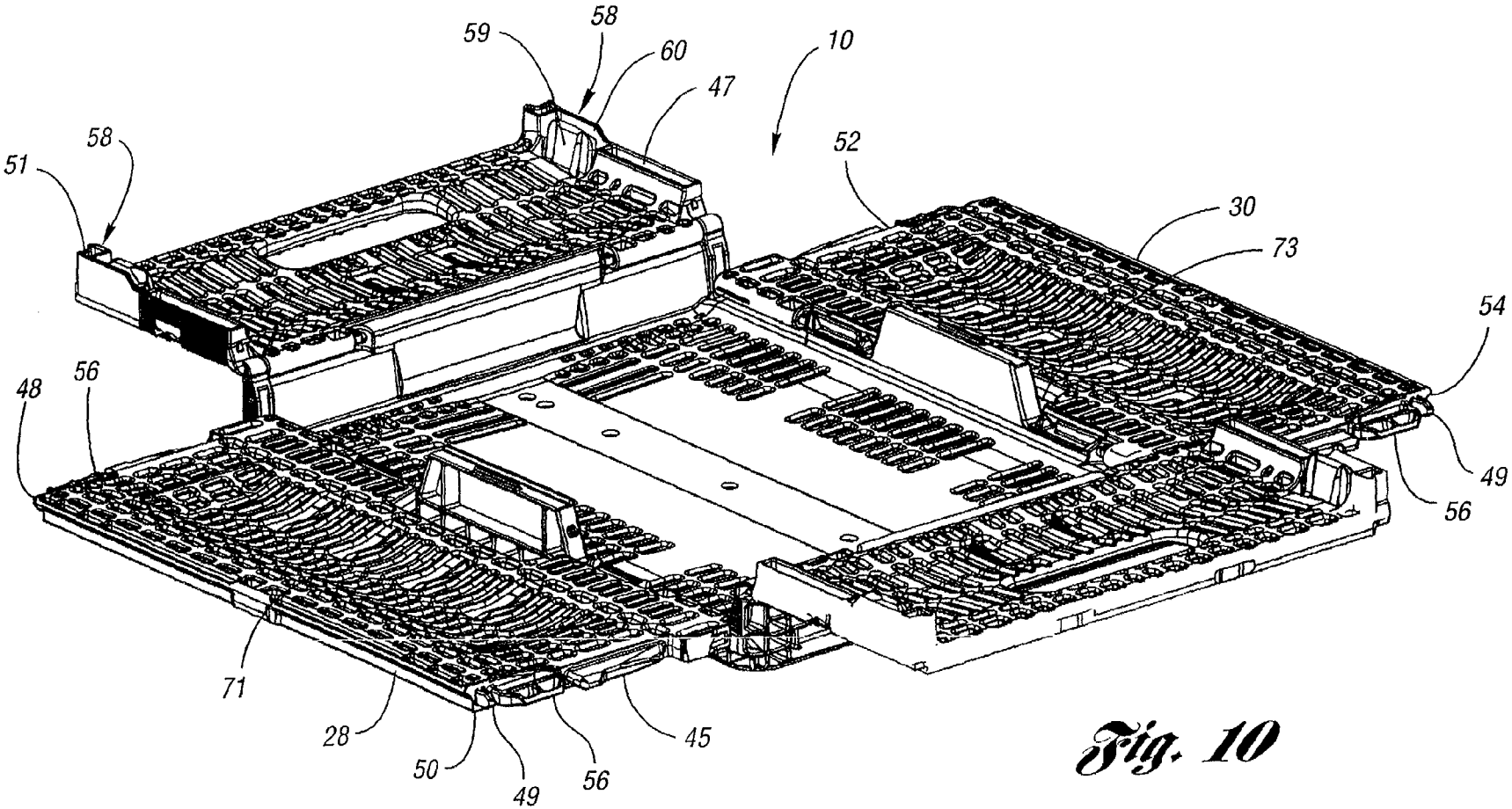
FIG. 10 illustrates the container of FIG. 1 with the side walls in an outwardly folded orientation.
Figure 11:
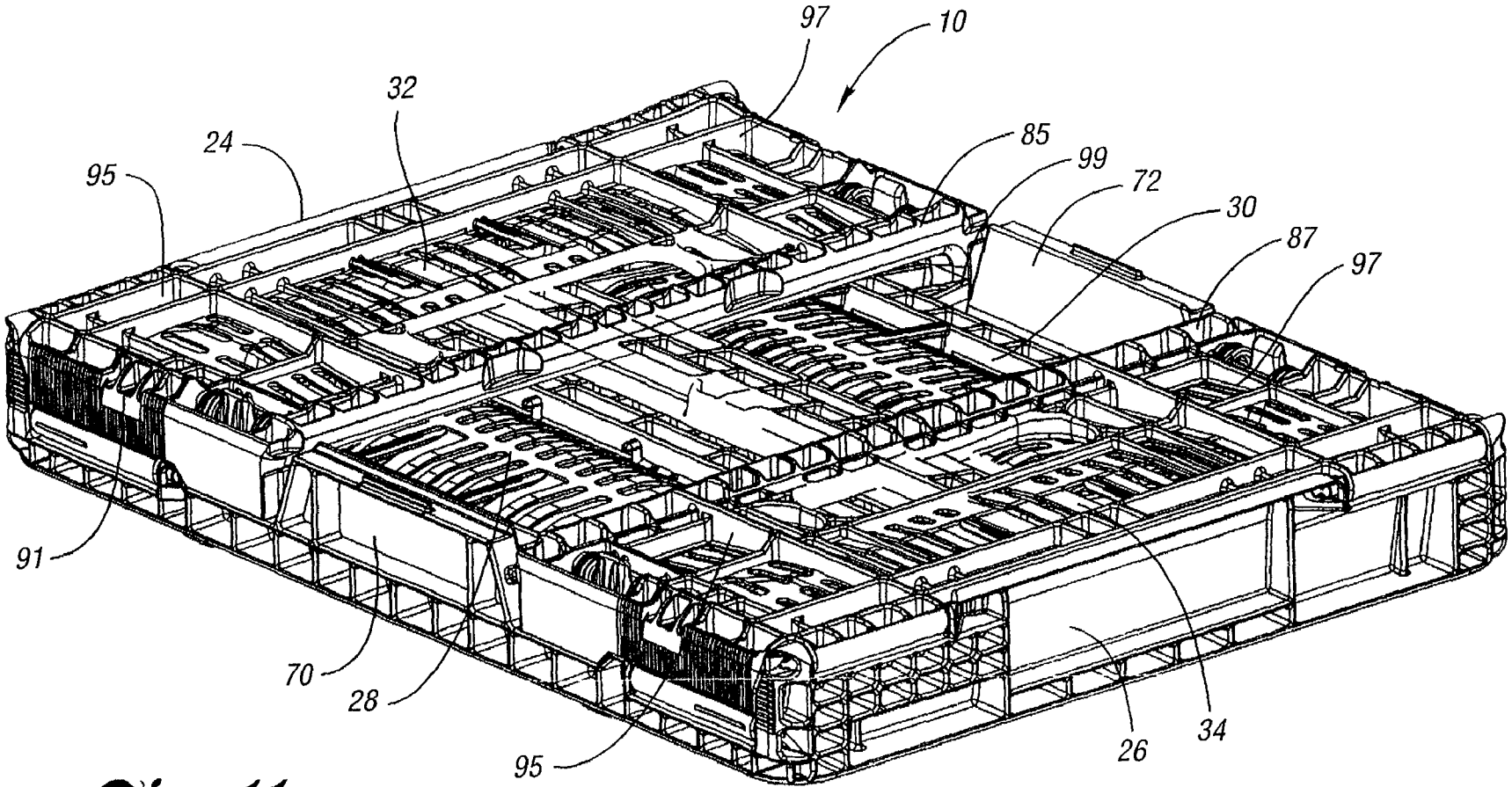
FIG. 11 illustrates the container of FIG. 1 with the side walls in an inwardly folded orientation, wherein the opposed side walls are first folded inwardly and then the opposed end walls are folded inwardly.

Referring to FIGS. 1, 2, 3, and 8, side walls 28, 30 are bowed outward, away from compartment 13, and have an arcuate shape. Particularly, in the embodiment shown, the central portion 74, 76 of side walls 28, 30 include the bowed (or scalloped) curvature. Side walls 28, 30, respectively, are each pivotably attached to base 12 by way of a hinging configuration or system 80 (best shown in FIGS. 7–8), located at edges 16,18 of bottom panel 14. Thus, side walls 28, 30 fold or pivot relative to base 12 at edges 16, 18. Such hinging system 80 allows side walls 28, 30 to be foldably positioned in three orientations: the assembled container orientation, as illustrated in FIGS. 1–2; the outwardly collapsible orientation, as illustrated in FIG. 10; and the inwardly collapsible orientation, as illustrated in FIG. 11. As shown in FIG. 2, hinging system 80 does not extend the length of base 12 but terminates at a distance away from each upstanding flange 24, 26, as well as a distance remote from an adjacent corresponding corner line 31. As best shown in FIGS. 8 and 10, side walls have a lower recessed edge portion 71, 73 for receiving and mating with corresponding base members 70, 72 when the container is in the assembled orientation of FIG. 1. Side walls may also include a mating recess 67 for receiving detent 69 therein during an assembled orientation.

As previous noted and as illustrated in FIGS. 1–2, 4, and 9, container 10 further includes a second pair of opposed side walls 32 and 34. For ease of reference and discussion, second pair of opposed side walls is herein referred to as pair of opposed end walls 32 and 34. Similar to side walls 28, 30, end walls 32, 34, are also bowed in an outward manner, having an arcuate shape where the central portion 75, 77 of end walls 32, 34 include the arcuate shape. Further, like side walls 28, 30, end walls 32, 34 are similarly pivotably attached to base 12 by way of a hinging mechanism 90 which is similar in structure to hinging mechanism 80 described above. However, unlike the side walls, end walls 32, 34 are folded relative to base 12 at a distance remote from bottom panel 14. Particularly, end walls 32, 34 are pivotably attached to upstanding flanges 24, 26, respectively, of base 12, proximate upper edges 25, 27, respectively, at a distance remote from bottom panel 14. The height of upstanding base wall flanges 24, 26 defines the aforementioned distance from which end walls 32, 34 are remote from bottom panel 14. As with the other walls discussed herein, end walls 32, 34 are orientable in three positions: assembled as shown as in FIGS. 1–2; outwardly collapsed as in FIG. 10; and inwardly collapsed as in FIG. 11.

The bowed features of the side and end walls generally serves to increase the interior volume 13 of container 10, thereby allowing containers 10 to store and transport more product.

Figure 9:
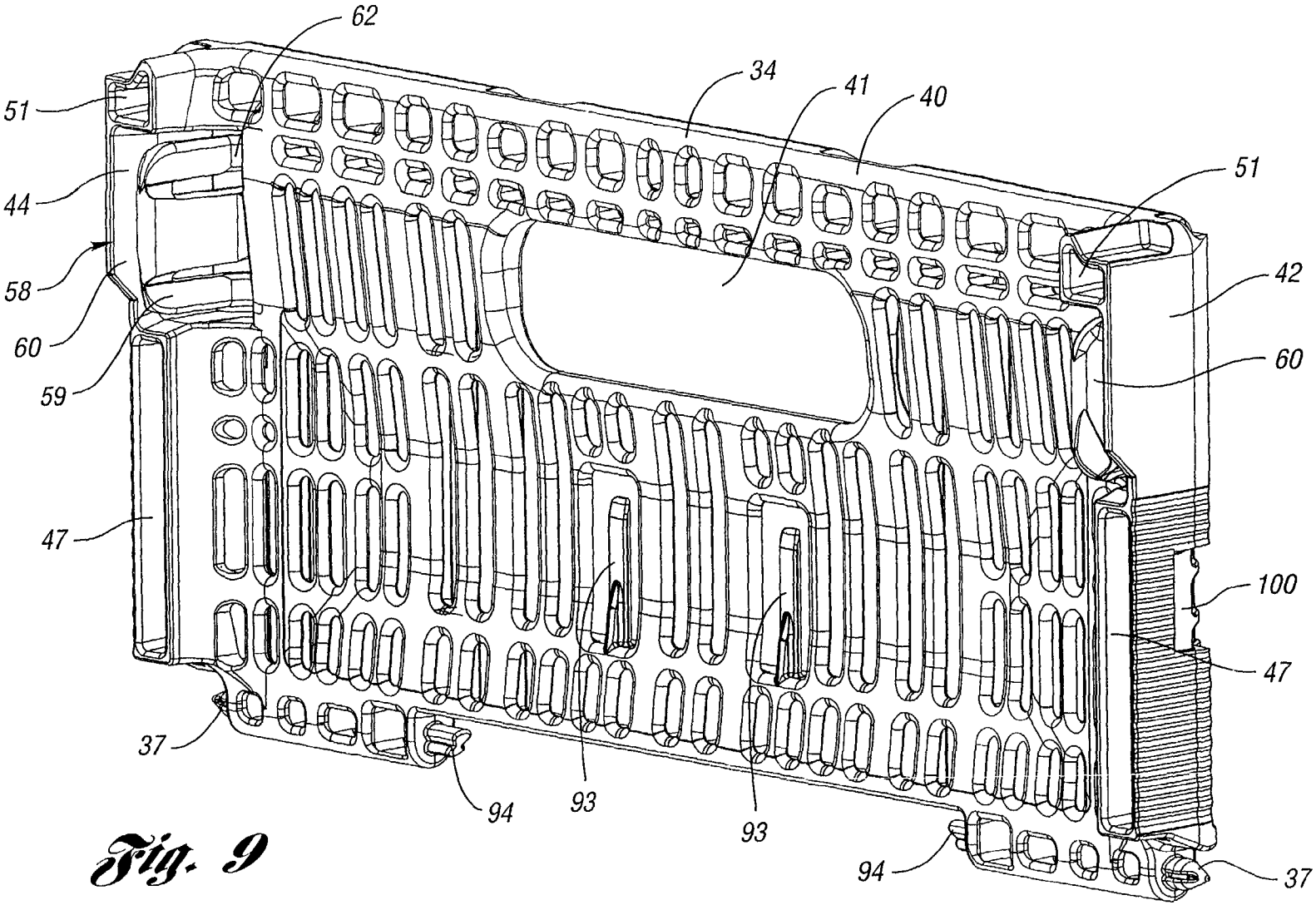
FIG. 9 is a perspective view of an end wall of the container of FIG. 1.

As best shown in FIG. 9 (and also in FIGS. 1 and 3), each end wall 32, 34 has a U-shaped cross section formed by a main end wall portion 40, and two shorter flange portions 42 and 44 integrally attached to main end wall portion 40 and located on either side of main end wall portion 40. Flange portions 42 and 44 are each oriented perpendicular to main end wall portion 40 and, in the assembled orientation of FIG. 1, are directed inwardly toward the other end wall (32 or 34) and side walls 28, 30. In an assembled orientation, the outer surface of flange portions 42, 44 are generally co-planar with the non-bowed portions of side walls 28,30.

Further included in container 10 is a locking or latching system for latching side walls (28,30) together with end walls (32,34) to achieve the desired stability when container 10 is oriented in the assembled orientation, as illustrated in FIGS. 8 and 10. With reference to FIG. 10, provided on each lateral edge 48, 50 and 52, 54 of side walls 28 and 30, respectively, is a latch member 56 extending outwardly therefrom.

Figure 12:
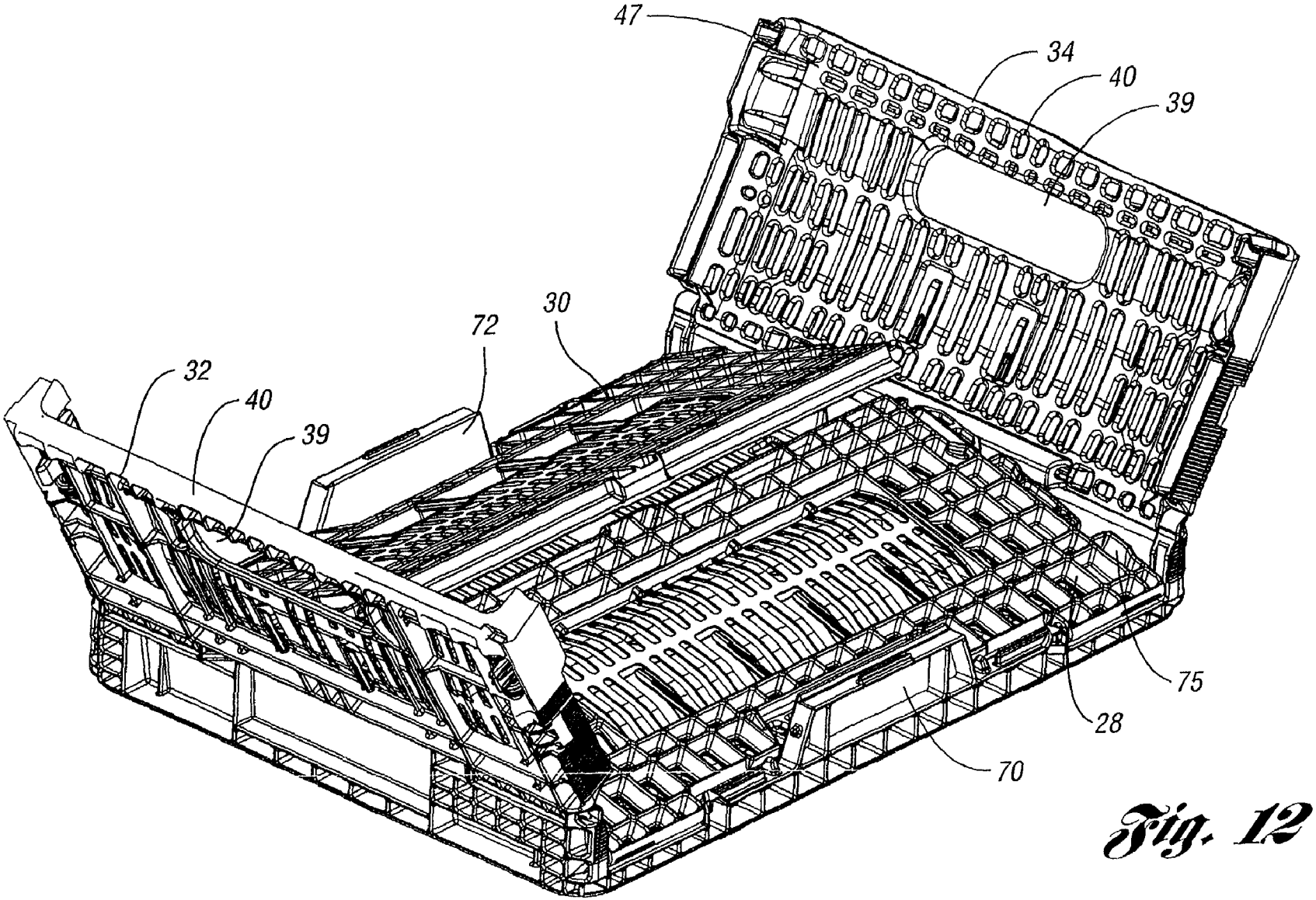
FIG. 12 illustrates the container of FIG. 1, wherein the side walls are partially folded inwardly and the end walls are partially folded outwardly.

By way of example with respect to FIGS. 9 and 10, for latching purposes, shorter flanges 42, 44 of end walls 32, 34 have a latch receiving system 58 provided for receiving latch member 56 therein. Latch receiving system 58 includes a receiver member 59, latch receiving aperture 60 and a spring member 62 (or living hinge). Aperture 60 is appropriately sized and shaped to firmly receive latch member 56. Receiver member 59 is disposed adjacent aperture 60. Receiver member 59 is attached to end wall 32, 34 by spring member 62, thus allowing it to be flexible over its length, and particularly actuable in the side to side direction. Thus, as illustrated in FIG. 12, as a side wall (28 or 30) is raised upwardly and an adjacent end wall (32 or 34) is also raised upwardly to receive latch member 56 into the assembled orientation, aperture 60 slidingly receives latch member 56 therein, thereby flexing spring member 62 laterally causing receiver member 59 to move from its rest position (see FIG. 18).

Figure 4:
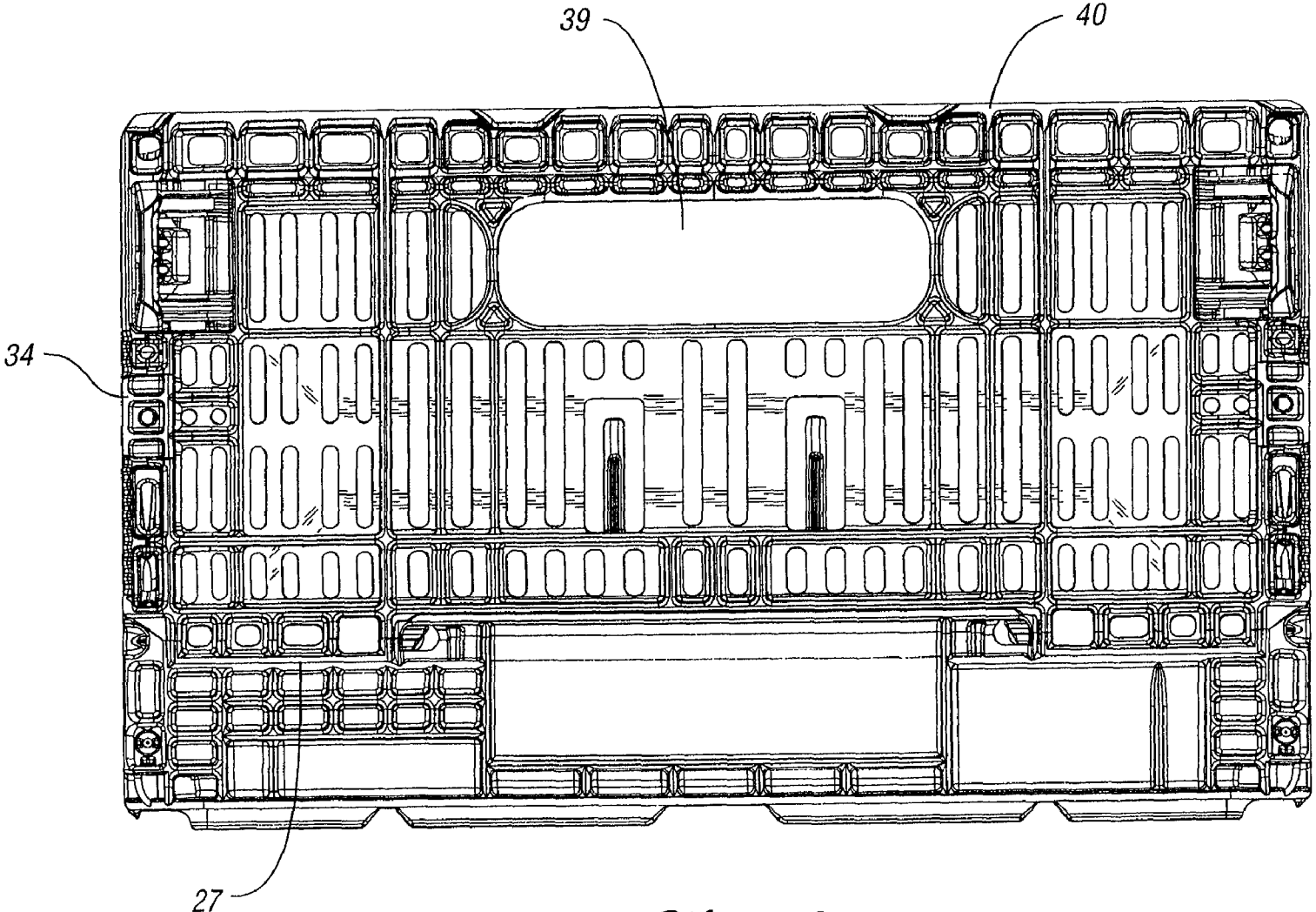
FIG. 4 illustrates an end elevational view of the container of FIG. 1.
Figure 18:
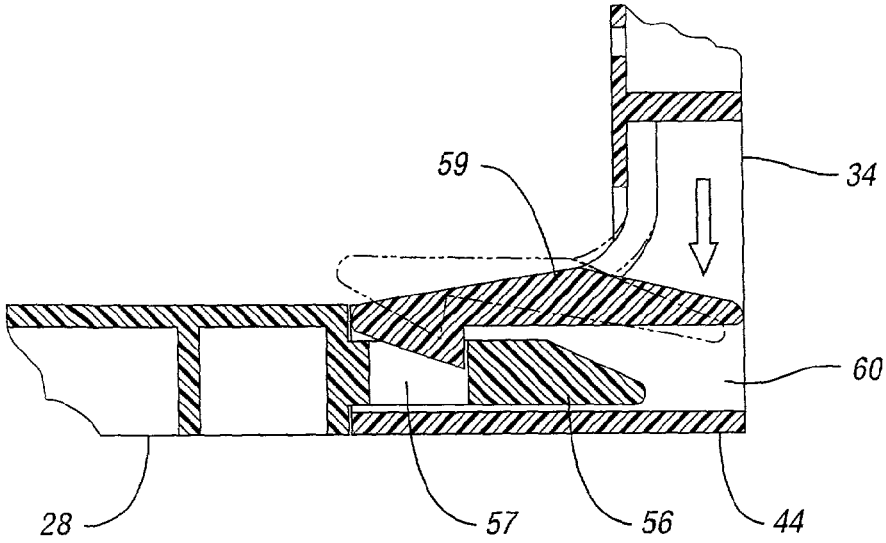
FIG. 18 is a top plan sectional view of the assembled latching system according to the present invention, and taken along line 16—16 of FIG. 8, for latching together side walls and end walls, according to the present invention.
Figure 19:
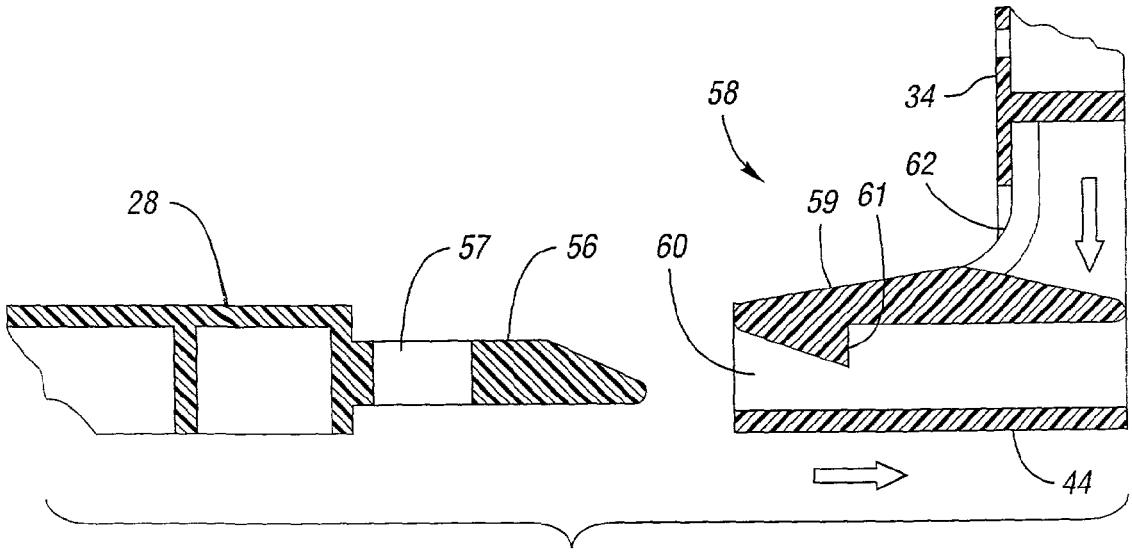
FIG. 19 is a top plan sectional view of the latching system of FIG. 16 in a disassembled orientation, with the side wall shown separated from the end wall.
Figure 20:
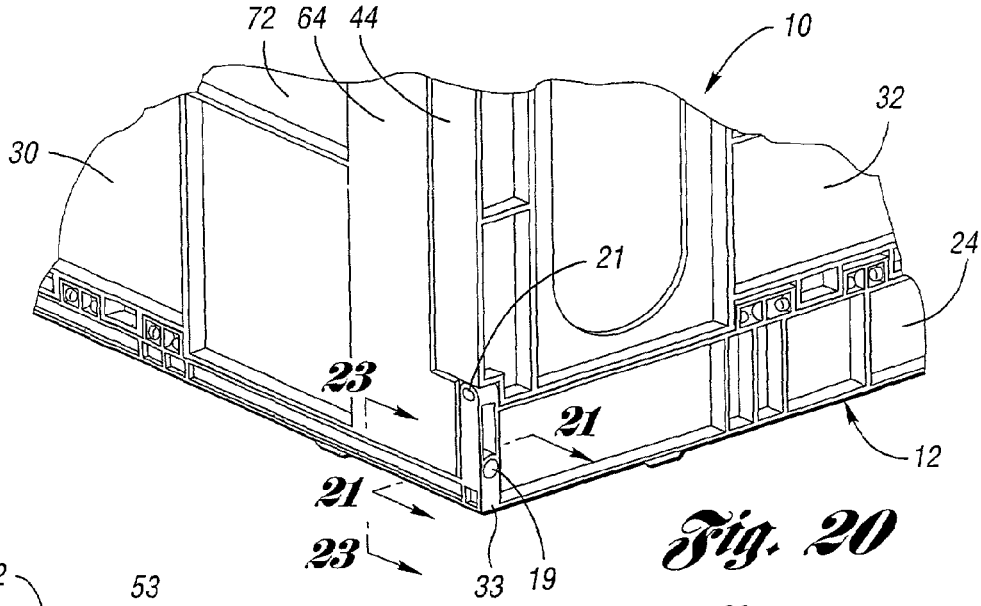
FIG. 20 is a perspective view of a corner portion of container 10 according to the present invention.

As further illustrated in the top plan sectional views of FIGS. 18–19, and particularly in the final assembled position of FIG. 18, a projection member 61 is disposed on receiver member 59 for being received by a corresponding aperture 57 formed in latch member 56. During the assembled state, projection 61 retains latching member 56 in a secure manner and provides the stability desired for maintaining container 10 in the assembled position. The depth of flanges 42,44 allows for receiving therein a longer latch member 56 than would otherwise be possible. With further reference to FIGS. 18 and 19, in order to collapse container 10 from the assembled orientation into the folded orientations of FIGS. 10 and 11, outer release member 55 (accessible from the outside of container 10) of receiver member 59 is actuated and moved laterally by the user (its movement shown in phantom in FIG. 18), and projection 61 is accordingly raised from aperture 57 in latch member 56, allowing latch member 56 to be released from latch receiver 58. Release member 55 is best illustrated in FIGS. 1, 4, and 12.

Figure 3:
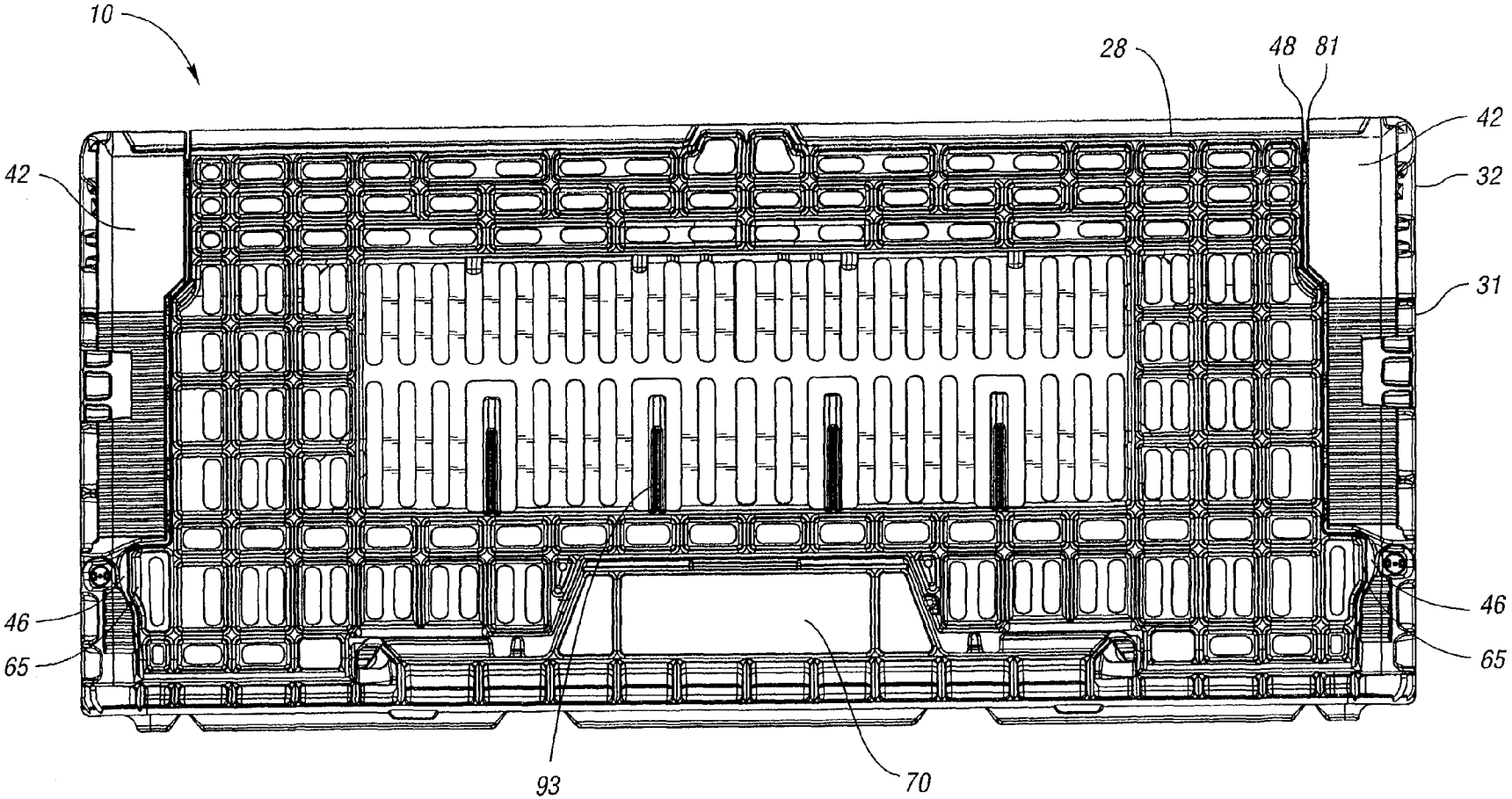
FIG. 3 illustrates a side elevational view of the container of FIG. 1.

The reduced stress concentration of the latch mechanism as provided according to the present invention is further illustrated in FIGS. 3 and 10. By example, refer generally to line 81 which is formed by the mating lateral edges of side wall 28 and end wall 32 (for example, line 81 defined by lateral edge 48 of side wall 28 and flange 42 of end wall 32). The latching that takes place is spaced apart from corner line 31 which otherwise is subjected typically to relatively higher stress concentration forces.

Again referring to FIGS. 8 and 10, in addition to latch member 56, each lateral edge 48,50 and 52,54 of side walls 28 and 30, respectively, may also include a first tab member 45, shown as relatively large and elongated, which projects from a lower portion of its respective edge of side walls 28 and 30 for alignment purposes. In an assembled container 10, tab member 45 is received by a corresponding opening 47 which resembles a narrow slot on shorter flanges 42, 44 of end walls 32, 34. The opening receives first tab member 45 in a secure fit for providing a manner by which to align and orient the adjoining walls, as well as secondarily assisting in securely holding side walls (28, 30) and end walls (32, 34) upright together during the assembled orientation. Moreover, upper portion of lateral edges (48, 50) and (52, 54) of side walls 28 and 30, respectively, may also include a second tab member 49 which is relatively smaller than first tab member 45. Like first tab member 45, in the assembled orientation second tab member 49 is received by a corresponding tab opening 51 formed in flanges 42 and 44 of end wall 32,34. Tab member 49 is provided generally for alignment purposes as well as to provide an additional point of engagement between the adjoining walls.

Figure 13:
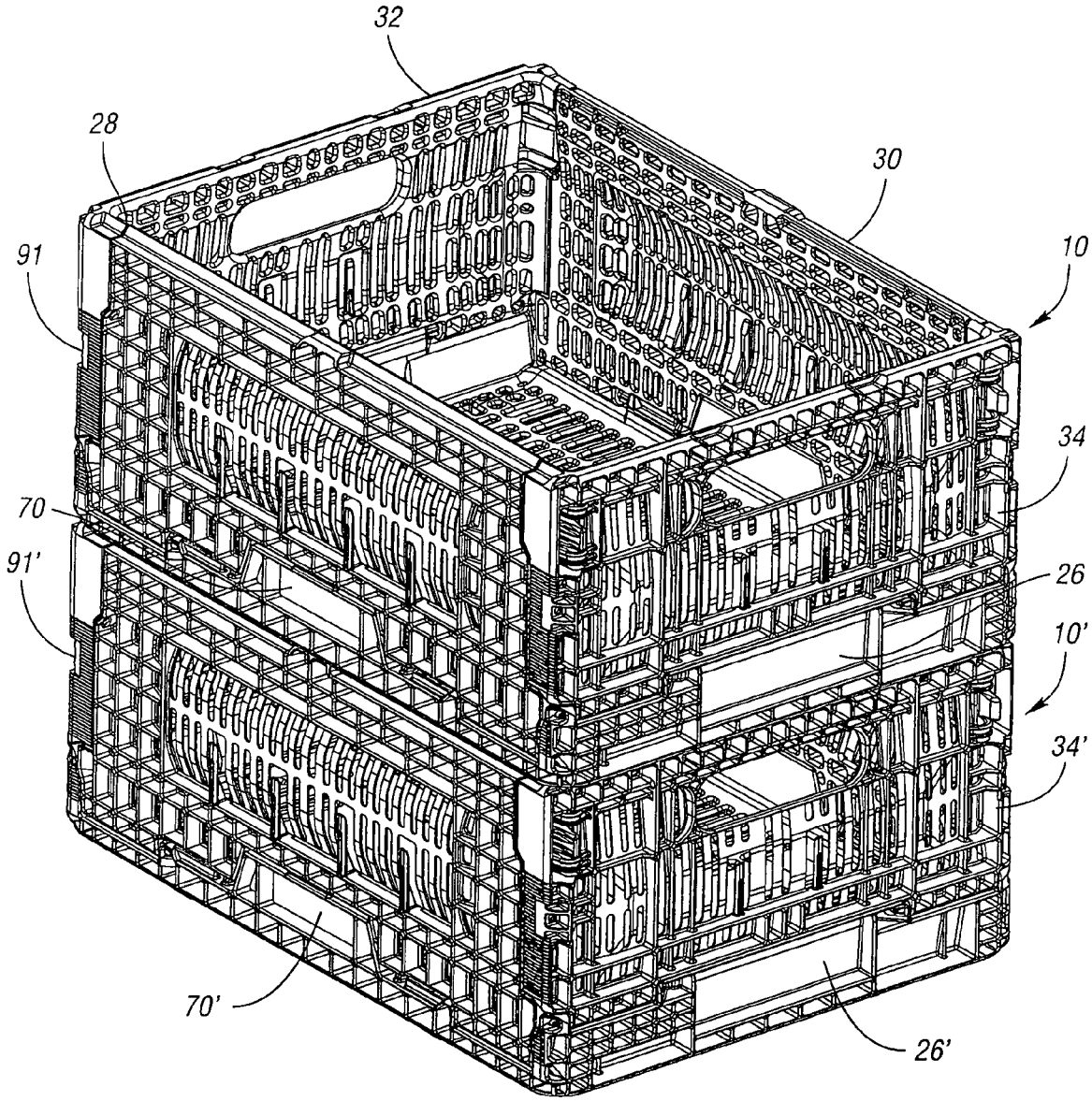
FIG. 13 illustrates a perspective view of the container shown in the assembled state of FIG. 1, wherein the assembled container is shown in a stacked orientation with a like container.

As illustrated in FIGS. 1–4 and 8–11, container 10 preferably includes a plurality of recesses 17 (or notches) around its perimeter formed in upper container edges. As illustrated in FIG. 13, container 10 is in an assembled orientation and is stacked with a like container 10' subjacent thereto. Components of container 10' similar to those of the container 10 are correspondingly numbered, with the addition of a prime (') designation. Container 10 is stacked directly above container 10' such that each of its plurality of foot tabs 15 are aligned with and are received within corresponding recesses 17' of container 10'. Such alignment between foot tab 15 and recess 17' provides additional stability and alignment to container 10 when in a stacked orientation with like container 10'.

Referring to FIG. 10, container 10 is illustrated in an outwardly folded configuration wherein side walls 28,30 and end walls 32,34 are collapsed and folded in an outward orientation. This configuration allows for improved washing of the interior of container 10. With reference now directed to FIG. 11, shown therein is container 10 having side walls 28,30 and end walls 32,34 oriented in an inwardly collapsed or folded orientation. Again the term inwardly designates a general direction of movement of the various walls toward base 12 and bottom panel 14. As FIGS. 11 and 14 indicate, the design according to the present invention allows container 10 to be compactly folded for storage and transport. In this orientation, side walls 28, 30 are pivoted inward via hinging mechanism 80, 90 and folded in a layered fashion on top of bottom panel 14. FIG. 11 illustrates side wall 28 folded first and side wall 30 subsequently folded thereupon. Subsequently end walls 32 and 34 are folded inward on top of side walls 28 and 30 via hinging system 90. With reference to FIG. 14 and discussed further herein, container 10 may be nested securely with a similar container when in this inwardly folded orientation. Note that when in this orientation, flange portions 42, 44 are substantially parallel with members 70, 72.

As shown in FIGS. 1 and 2, each end wall 32, 34 includes a hand opening 39 ideally suited to be used as a handle in order to carry container 10. With reference to FIGS. 1 and 2, container 10 also includes a plurality of flexible vertical tabs 93 formed integrally with side walls 28, 30 and end walls 32, 34 so that a label, index card or other identifier may be inserted and held therein.

With regard to hinging systems of container 10, shown in association with the individual perspective views base 12 of FIG. 7 and the walls of FIGS. 8 and 9, are the hinging systems 80 (for side walls 28, 30) and 90 (for end walls 32, 34). Specifically, hinging systems 80 and 90 include a plurality of lower hinge portions 82 and 92, respectively, integrally formed with base 12 to mate with and attach to upper hinge members 84 and 94, respectively, included on the corresponding walls (See FIGS. 7, 8, and 9). These hinge members are spaced apart generally on each side of upstanding member 70, 72. Mating upper hinge portions 84, 94 are spaced along their respective lower edges of side walls (28,30) and end walls (32,34), respectively, for mating with corresponding lower base hinge members 82, 92 of base 12. Of course, this type of hinge is shown by way of example and not limitation, as the hinge system utilized may be any type known or contemplated which is feasible for this use.

Figure 21:
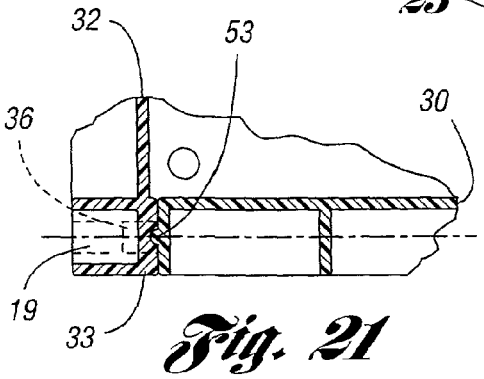
FIG. 21 is a sectional view taken along the line 21—21 of FIG. 20.
Figure 22:
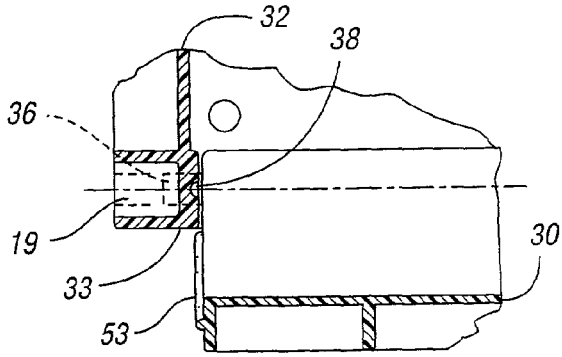
FIG. 22 is a sectional view similar to that shown in FIG. 21, but with the end wall in an outwardly folded orientation.

With further reference to the hinging systems, base 12 includes at either end of upstanding flange 24,26 an upstanding corner member portion 33 which projects upward past upper edges 25 and 27 and is integrally formed with upstanding flanges 24, 26. Each corner portion 33 includes two openings 19 and 21 formed therein. Each corner portion 33 also defines a corner line 31. Opening 19 is located relatively lower and opening 21 is located relatively higher along the height of corner portion 33. Each co-linear pair of openings 19 is provided to receive a corresponding projection 36 (shown in FIG. 8) provided at each end of a corresponding side wall (28, 30) for providing an additional pivoting point for each side wall with respect to base 12. Conversely, each co-linear pair of openings 21 share an axis generally adjacent upper surface (25,27) of upstanding wall 24,26. As shown in the sectional views of FIGS. 21 and 22, openings 21 are provided to receive a corresponding projection 37 (see FIG. 9) provided at either end of each end wall (32,34) thereby allowing each end wall to pivot with respect to base 12. Thus openings 19 and 21 provide for an additional pivot point and anchor point along the lateral sides of each wall, thus allowing for a stable hinging configuration and attachment to base 12 of each wall.

Figure 23:
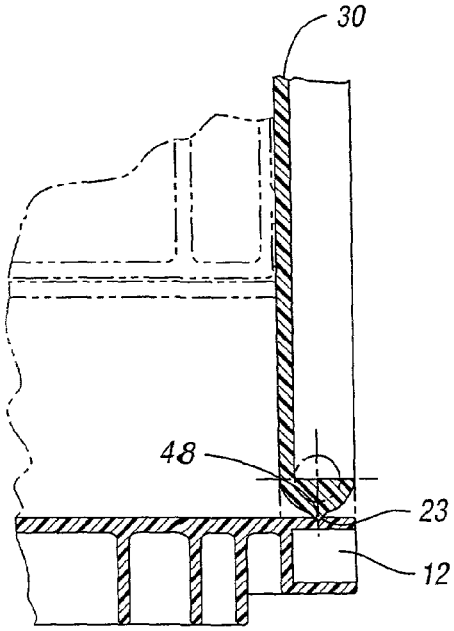
FIG. 23 is a sectional view taken along the line 23—23 of FIG. 20.
Figure 24:
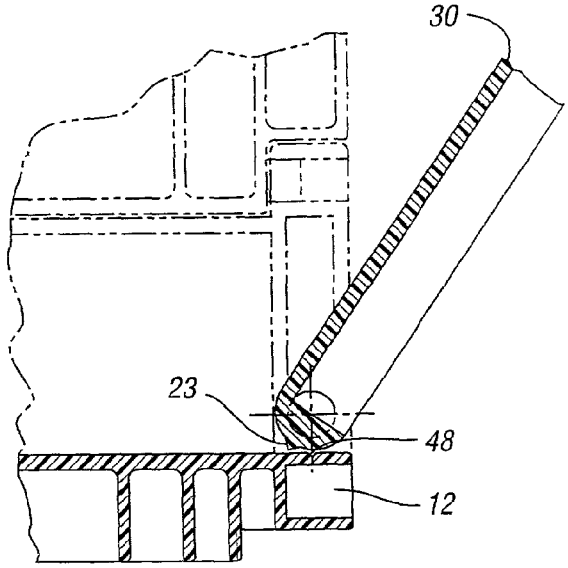
FIG. 24 is a sectional view similar to that shown in FIG. 23, but with the side wall in an outwardly folded orientation.

As illustrated in the sectional views of FIGS. 23 and 24, the lower edge of each side wall may include a relatively small detent 23 (or ridge) which is received in a corresponding channel in base 12. Referring again to FIGS. 21 and 22, the side walls may include a projection 53 which extends along the edge of the sidewall that mates with and corresponds to corner portion 33, and is received by a mating channel 38. These projections allow for interference between the walls the corresponding base and corner portions, such that when the walls are moving between the assembled and the collapsed orientations, the walls preferably do not fall freely, but instead require assistance from the user (however minimal). Thus, during container assembly, the user does not need to support all four walls when attempting to assemble the container.

Figure 15:
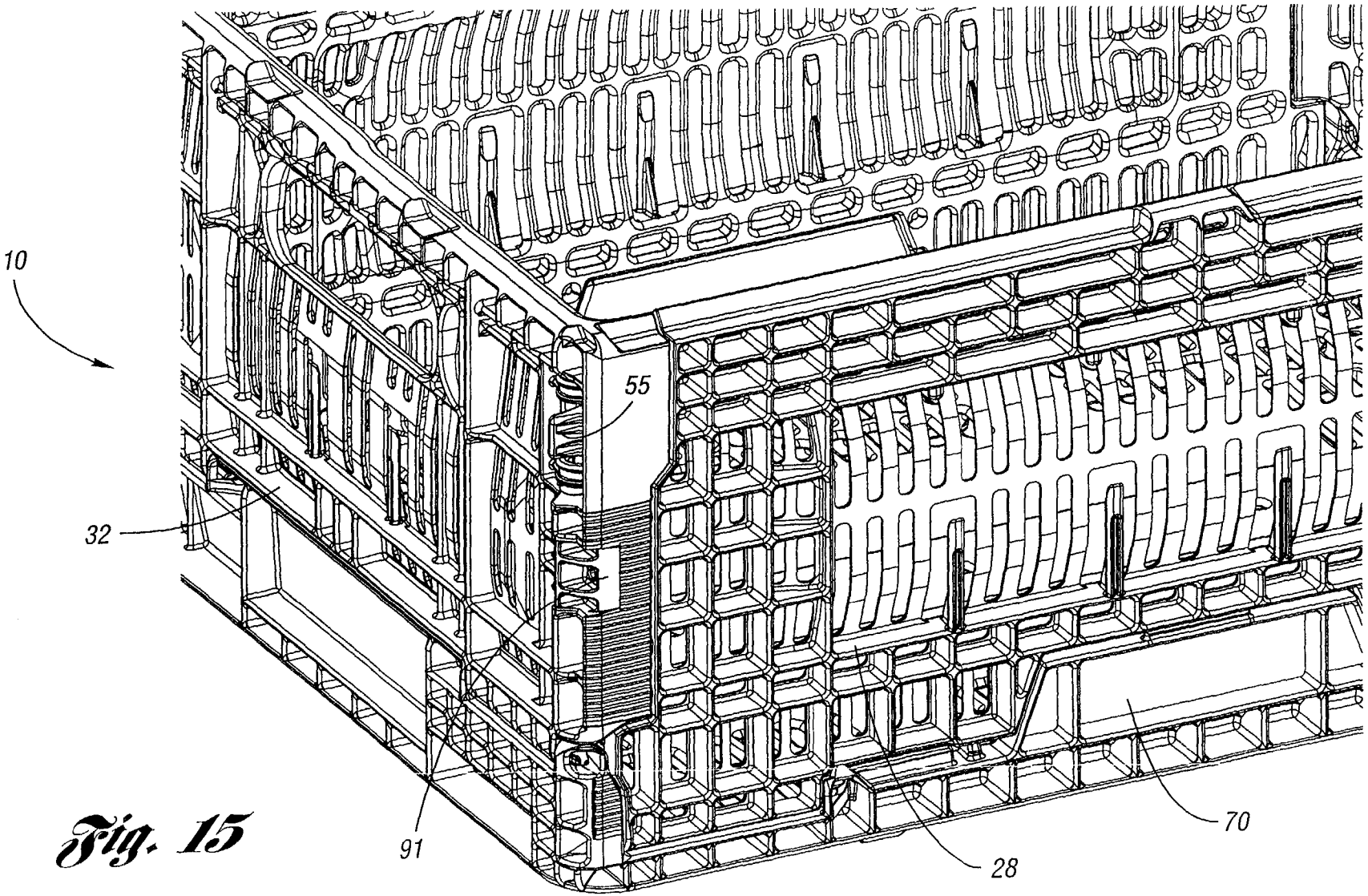
FIG. 15 is a perspective view of a corner portion of the container of FIG. 1 showing a mating adjacent side wall and end wall.
Figure 16:
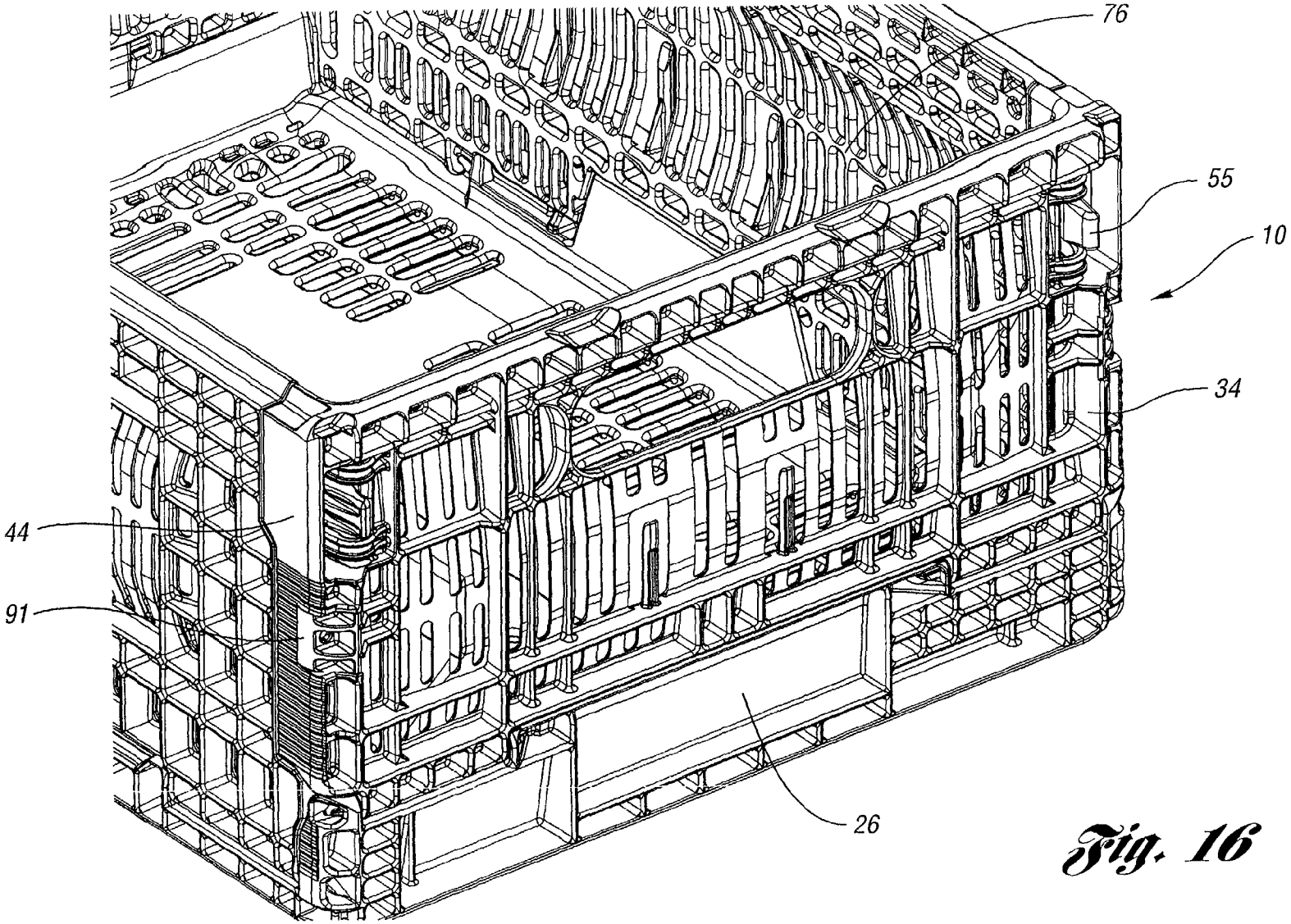
FIG. 16 is a perspective view of a corner portion of the container of FIG. 1 showing another mating adjacent side wall and end wall, and shown from a different angle than that in FIG. 15.

As shown in FIGS. 1, 3, and 15, side walls (28, 30) have a portion 65 that extends into recess 46 in the corner area and projects outboard beyond edge 48, 50. Initial studies indicate that portion 65 generally provides for a stronger container, in terms of strength-to-weight ratio, particularly during top loading of container 10.

Figure 17:
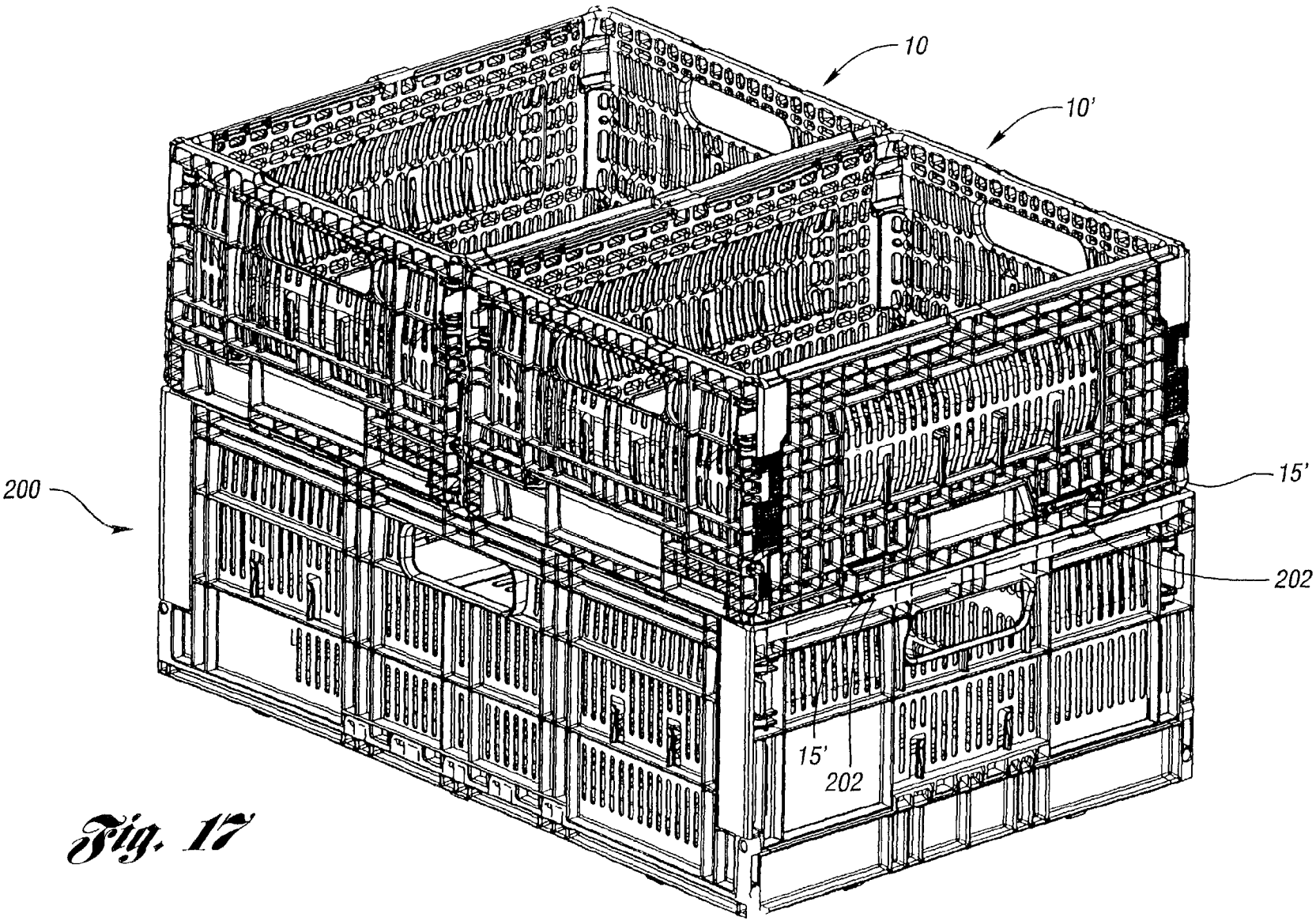
FIG. 17 is a perspective view of two like containers according to the present invention which are disposed side-by-side and oriented in a stacked orientation with a single larger container.

FIGS. 2 and 6 illustrate bottom surface 63 of container 10 and illustrate the features which permit nesting of similar containers 10 on top of each other when they are in the inwardly folded orientation (as in FIG. 11). This design permits an inwardly collapsed container 10 to be stacked on top of a like folded container so that the resulting stack-up is stable (see FIG. 14). In an embodiment, this design of container 10 is also adapted to be positioned side-by-side with a similar container 10' and stacked on top of an assembled larger container 200 (see FIGS. 17 and 35–36). Thus, feet 15 on bottom surface 63 of container 10 are securely received by corresponding openings 202 formed in the upper edge of container 200. (Larger container 200 may particularly be represented by container 110 disclosed herein.)

With reference to FIG. 14, illustrated is a perspective view of a pair of containers 10 and 10' according to the present invention which are inwardly folded as shown in FIG. 11 and which are in a nested orientation. With further reference to FIG. 2, illustrated is the bottom perspective view of container 10, such that the features that permit for nesting when container 10 is in the inwardly collapsed state of FIG. 11 are shown. For example in FIG. 2, bottom surface 63 of bottom member 14 include a first and second transverse recess portions 86 and 88 which are positioned among the downwardly projection rib portion of bottom surface 63. Transverse recess portions 86, 88 received therein the upper portion 85, 87 of end walls 32, 34 when in the inwardly folded state of FIG. 11. This impedes the lateral movement of container 10 on container 10' when container 10' is in the inwardly folded state. Similarly, bottom projecting portions 96 and 98 of bottom surface 63 are received within recesses 95, 97 of end walls 32, 34. Bottom projecting portion 89 is received within the area 99 defined between upper portions 95, 97 of end walls 32, 34 when in the inwardly collapsed state of FIG. 11. Thus, bottom surface 63 design of container 10 mates with and accommodates the corresponding outer surface of inwardly folded end walls 32', 34' of subjacent container 10' to provide for a stable and secure nested configuration. In keeping with the present invention, it is fully contemplated that bottom surface 63 of base 12 may be designed to provide the proper rib patterns and recesses to be capable of accommodating various end walls heights. It is also contemplated that there are numerous ways of securely stacking containers according to the present invention and is not limited in any way to the design illustrated.

Referring to FIGS. 1, 11, and 15, container 10 also includes a notch or recess 91 which has a radius and defines a generally angled surface disposed at the corner line 31 of each end wall 32, 34. Notch 91 typically receives a nylon strap (not shown) which is used to strap containers 10 together securely, generally in an automatic palletizing process. In typical containers without recess 91, the containers may be subject to excessive forced by the pallet strap, wherein the pallet straps may be pulled too tight, causing damage to the container. Notch 91 provides a way to align the strap and provides ease of placement of the strap, such that in the automated palletizing process, the strap will work its way into notch 91, and reduce the likelihood of damage of containers 10. Notch 91 is also particularly located in an area of container 10 which has relatively greater strength and stability than other areas of the container in order to withstand the strapping forces (in container 10, that area being adjacent the latch mechanism and the flanged portions 42, 44 of end walls 32, 34).

Figure 25:
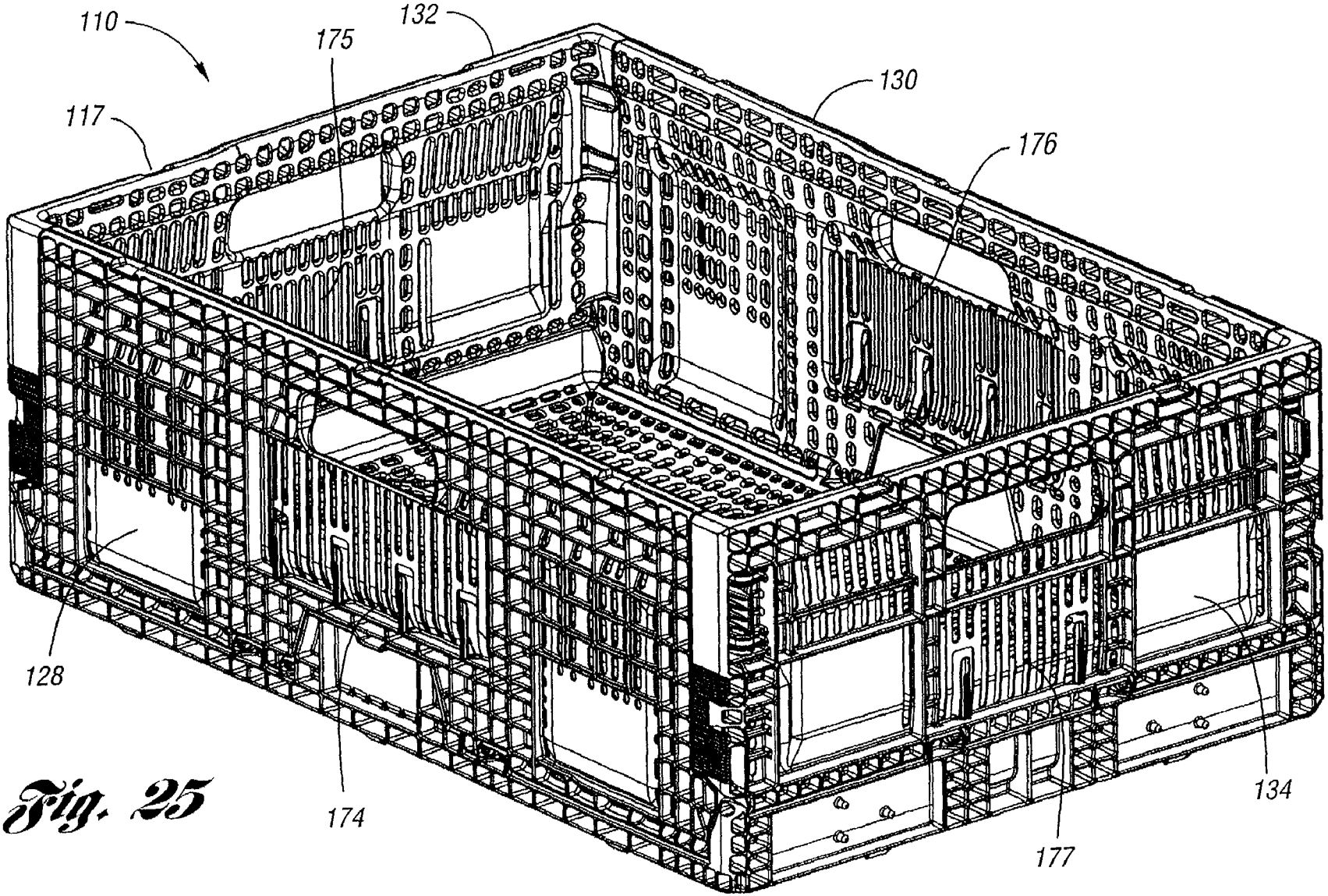
FIG. 25 illustrates a perspective view of a second embodiment of the container according to the present invention.

With reference to FIG. 25, illustrated is another embodiment of the container according to the present invention, designated as container 110. Note that those components similar to the first embodiment are designated by a like reference number with the addition of a "1" prefix. As illustrated therein, side walls 128, 130 include bowed out portions 174, 176, and end walls 132, 134 include bowed out portions 175, 177. Base also includes upstanding members 170, 172, similar to those of the first embodiment.

Figure 26:
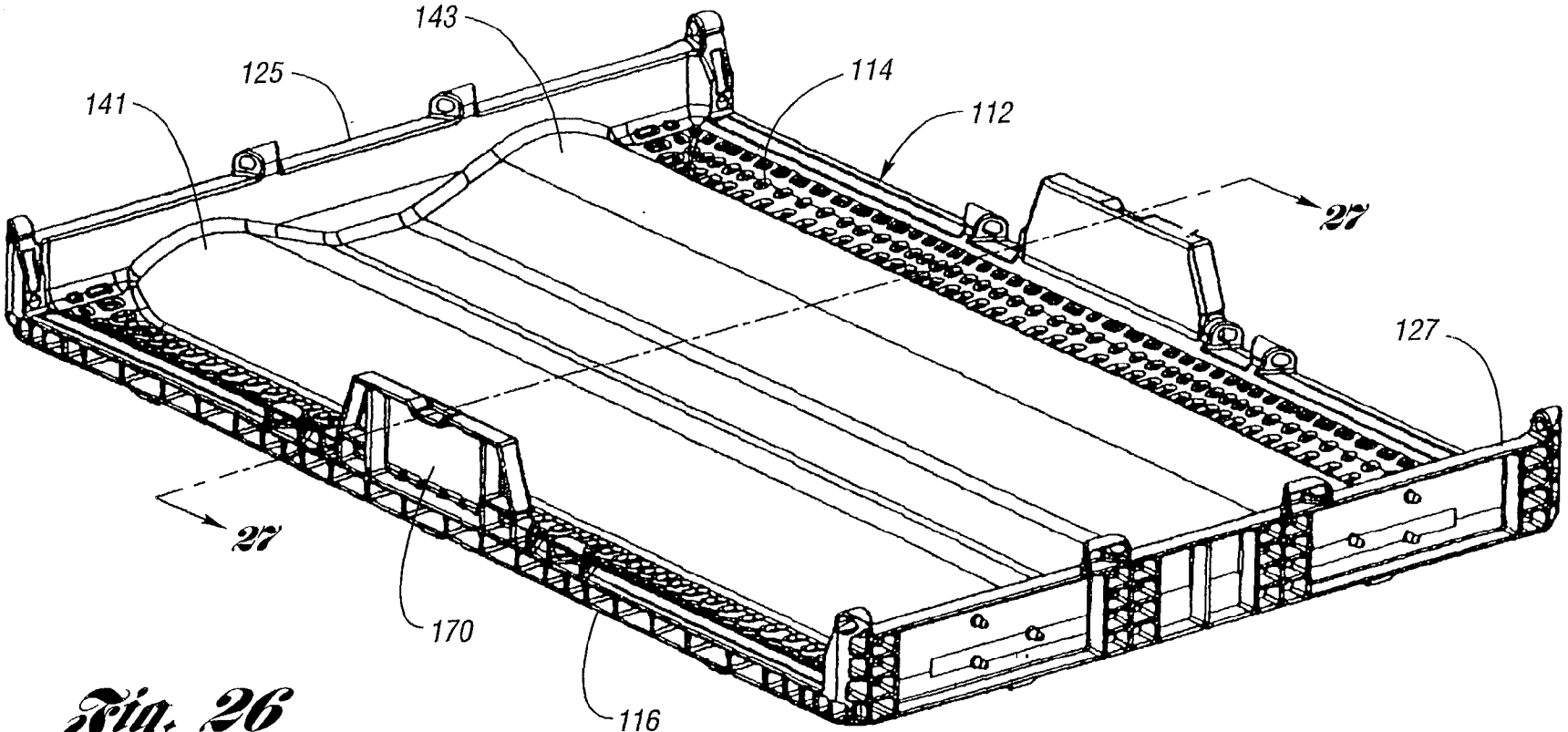
FIG. 26 illustrates a perspective view of a base of the second embodiment.
Figure 27:
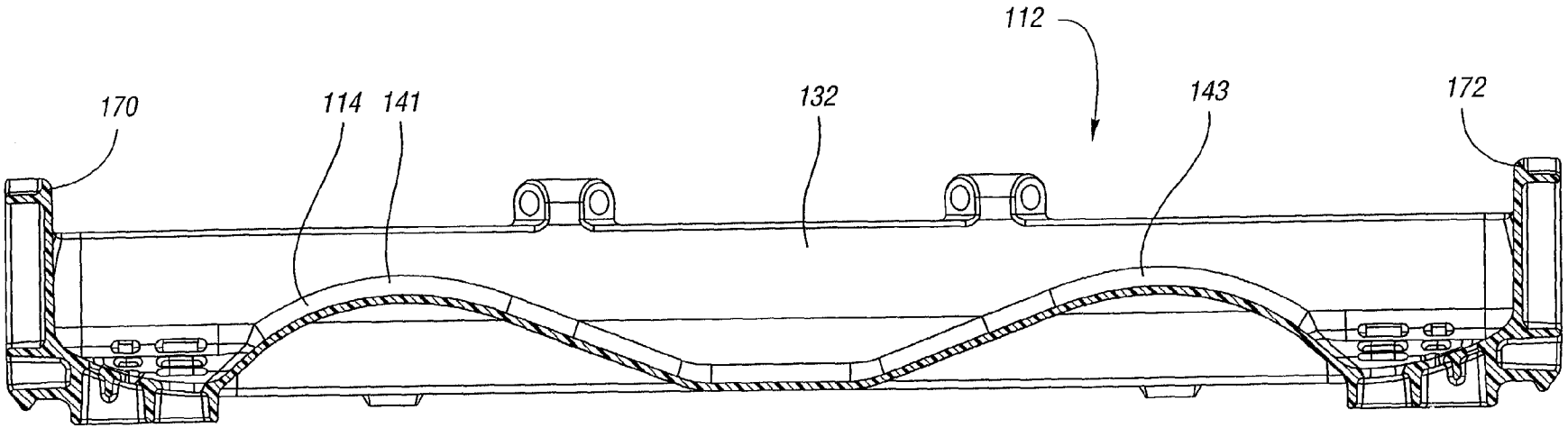
FIG. 27 illustrates a cross-sectional view of the base taken along the line 27—27 of FIG. 26.
Figure 28:
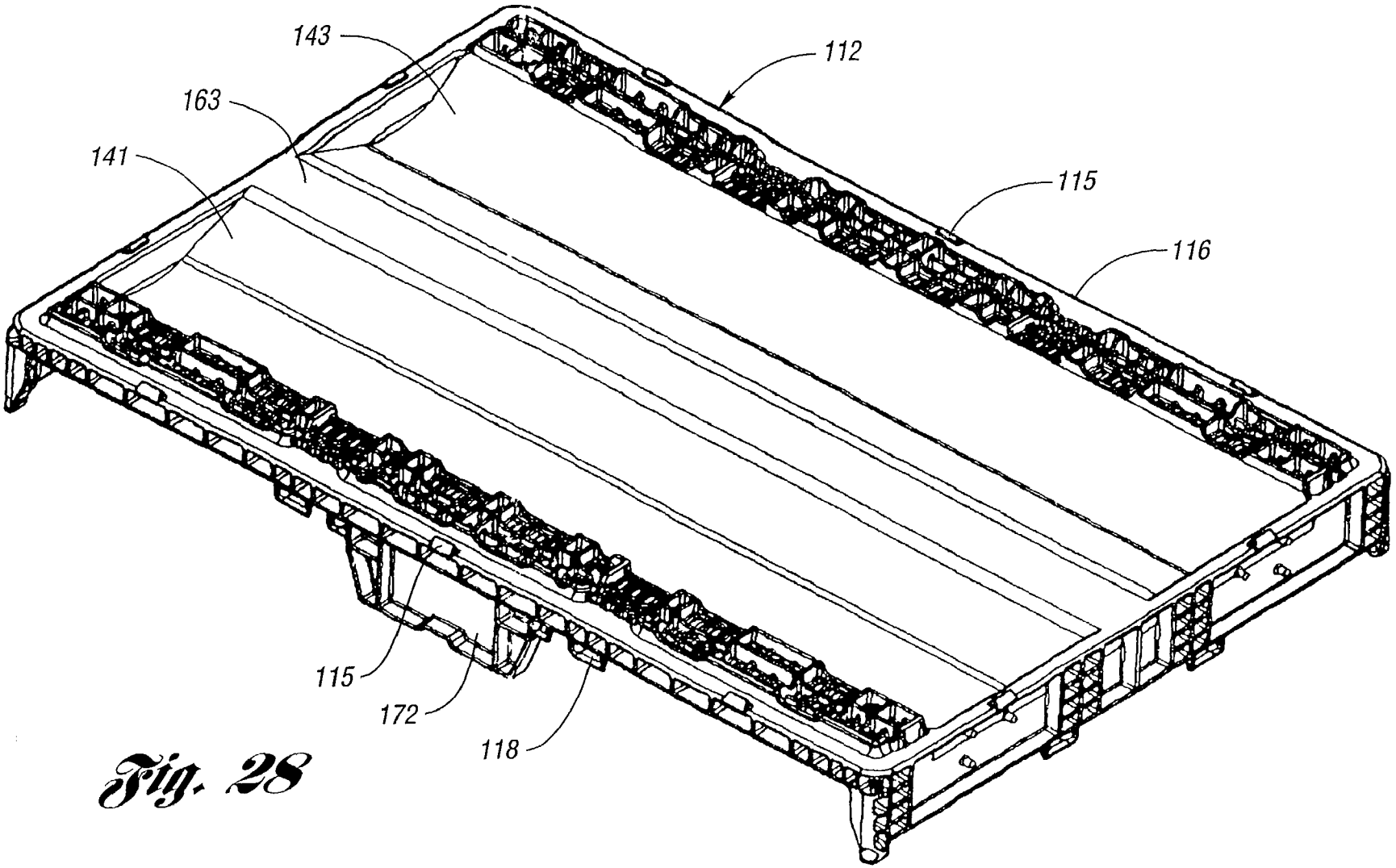
FIG. 28 illustrates a bottom perspective view of the second embodiment.

FIG. 26 illustrates a top perspective view of a base 112 of the second embodiment of container 110, while FIG. 28 is a bottom perspective view of base 112. FIG. 27 is a cross-sectional view taken along the line 27—27 of FIG. 26. Referring to these drawings, base 112 has a bottom panel 114 which includes at least one curved portion—and preferably two curved portions 141, 143—which extend between edges 116 and 118, the curved portions being bowed upward with a relatively slight arcuate shape, instead of having a typical flat profile. This curved portion is illustrated to be wave-like or sinusoidal, and disposed in the central portion of bottom panel 114. This bowed feature of bottom panel 114 serves to add stability to the container and augment the life of the container, as well as provide protection to the contents of containers stacked therebelow. Particularly, when container 110 is filled or has goods placed therein, the weight of the goods will exert load upon bottom panel 114. Under this load, the bowed design of bottom panel 114 will tend to cause bottom 114 to flatten. This is desirable in comparison to a container having a typically flat bottom which under the same load described above, will tend to sag and bow downward, thereby, decreasing the container's strength, stability, and life, and also possibly causing damage to the contents of the container therebelow. Also, when container 110 is adapted to store and transport produce such as banana bunches, the bowed feature of bottom panel 114 is adapted to be received within the claw shape of the banana bunch, thereby providing a more stable transport and more secure packaging of the fruit.

Figure 29:
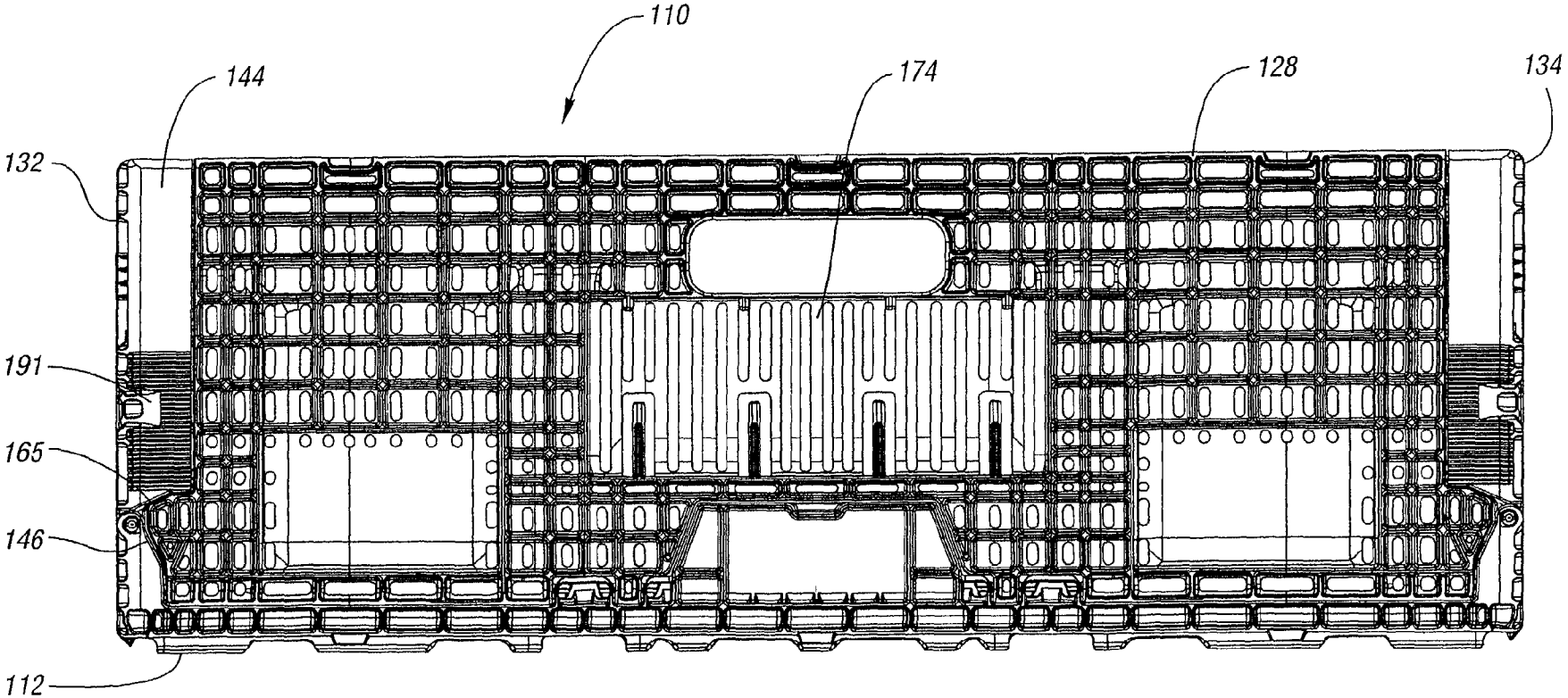
FIG. 29 illustrates a side elevational view of the second embodiment.
Figure 30:
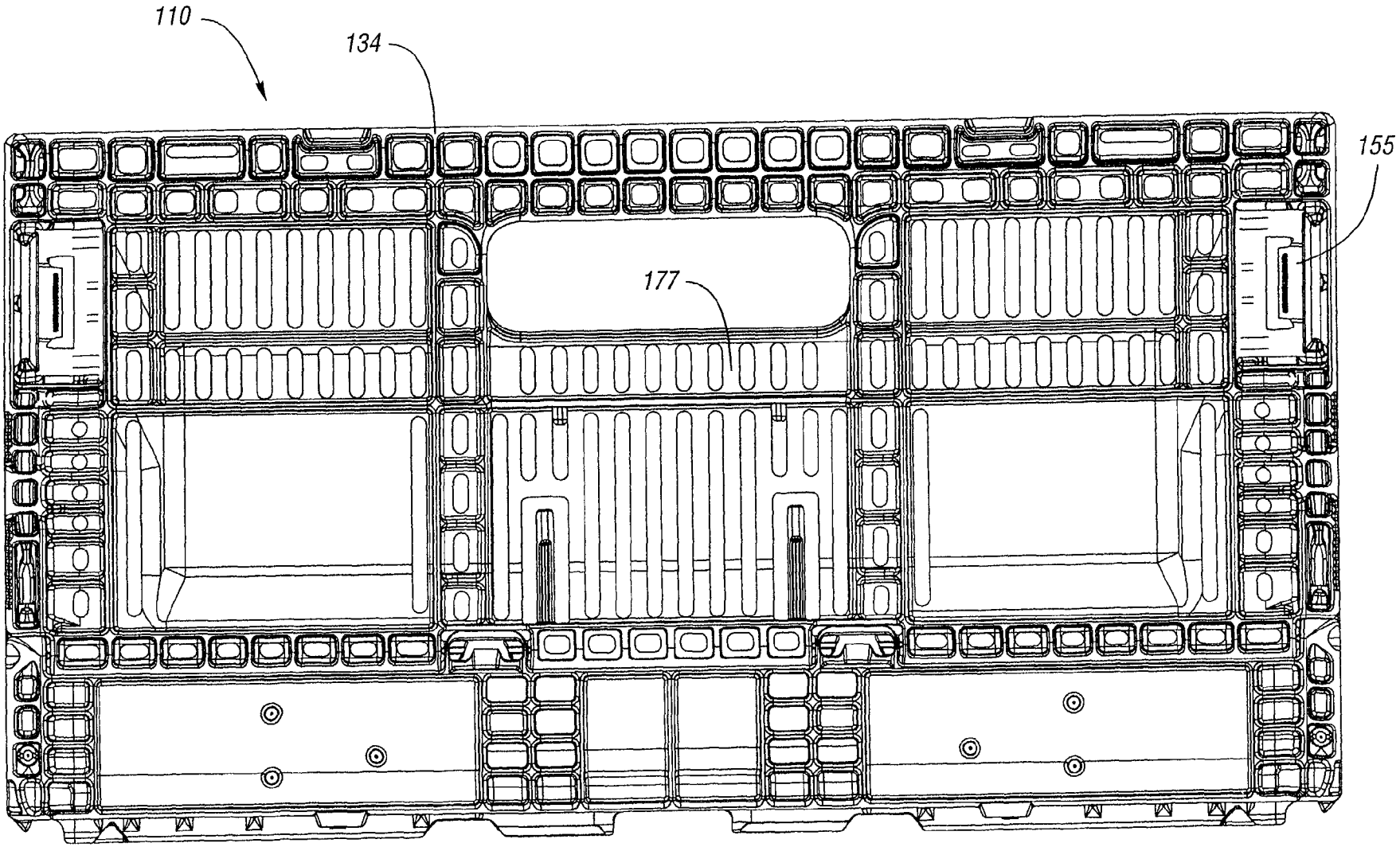
FIG. 30 illustrates an end elevational view of the second embodiment.

FIG. 29 is a side elevational view of container 110 in an assembled orientation, as in FIG. 25. As illustrated, like the first embodiment, container 110 also includes notch 191 for the palletizing straps, and further includes the portion of side walls 128, 130 which extends into and mates with a corresponding recess 146 in the corner region, proximate the corner hinge connection. FIG. 30 is an end elevational view again illustrating features of end wall 134.

Figure 31:
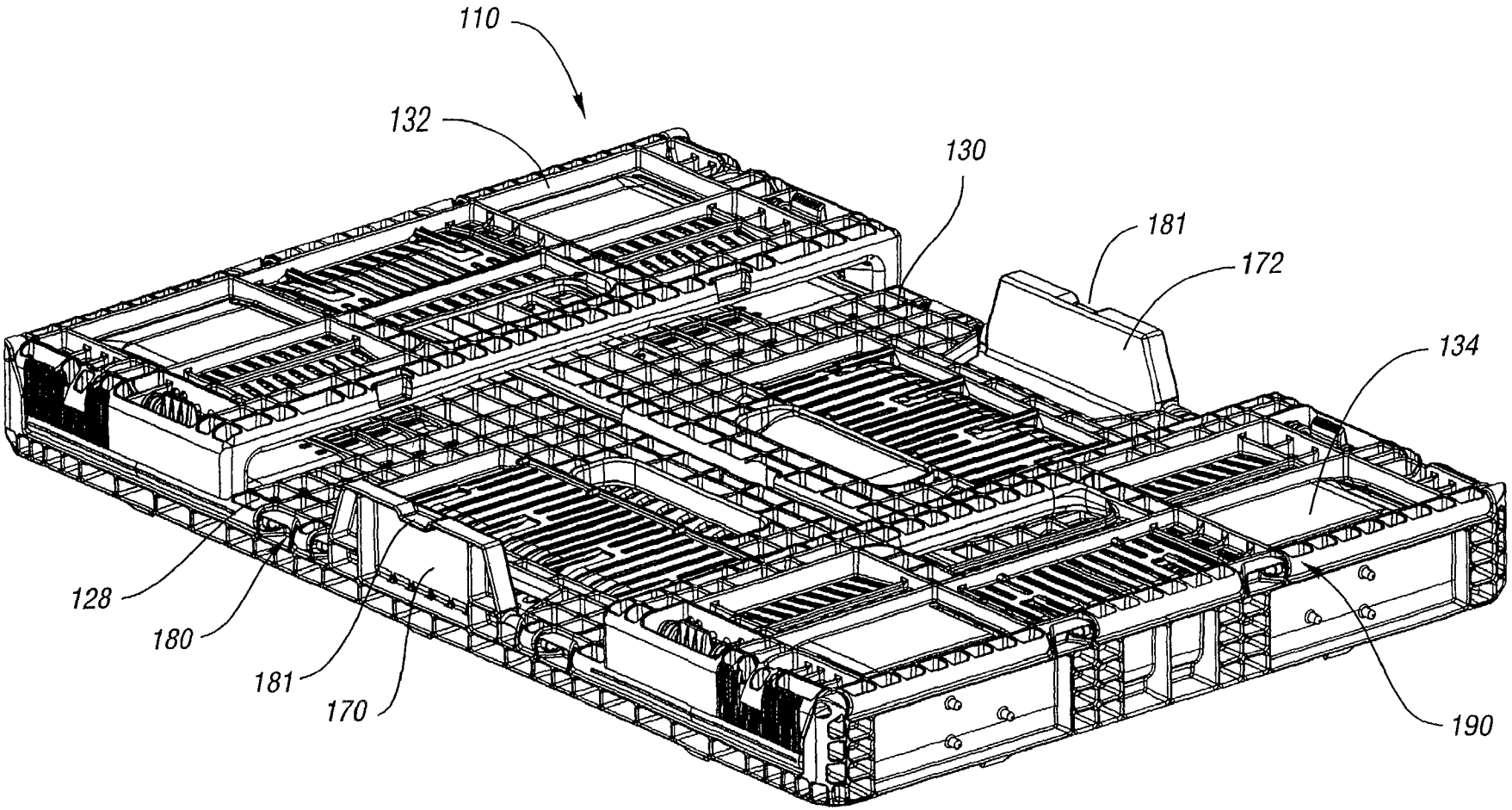
FIG. 31 illustrates a perspective view of the second embodiment, wherein the side and end walls are in an inwardly collapsed position.
Figure 32:
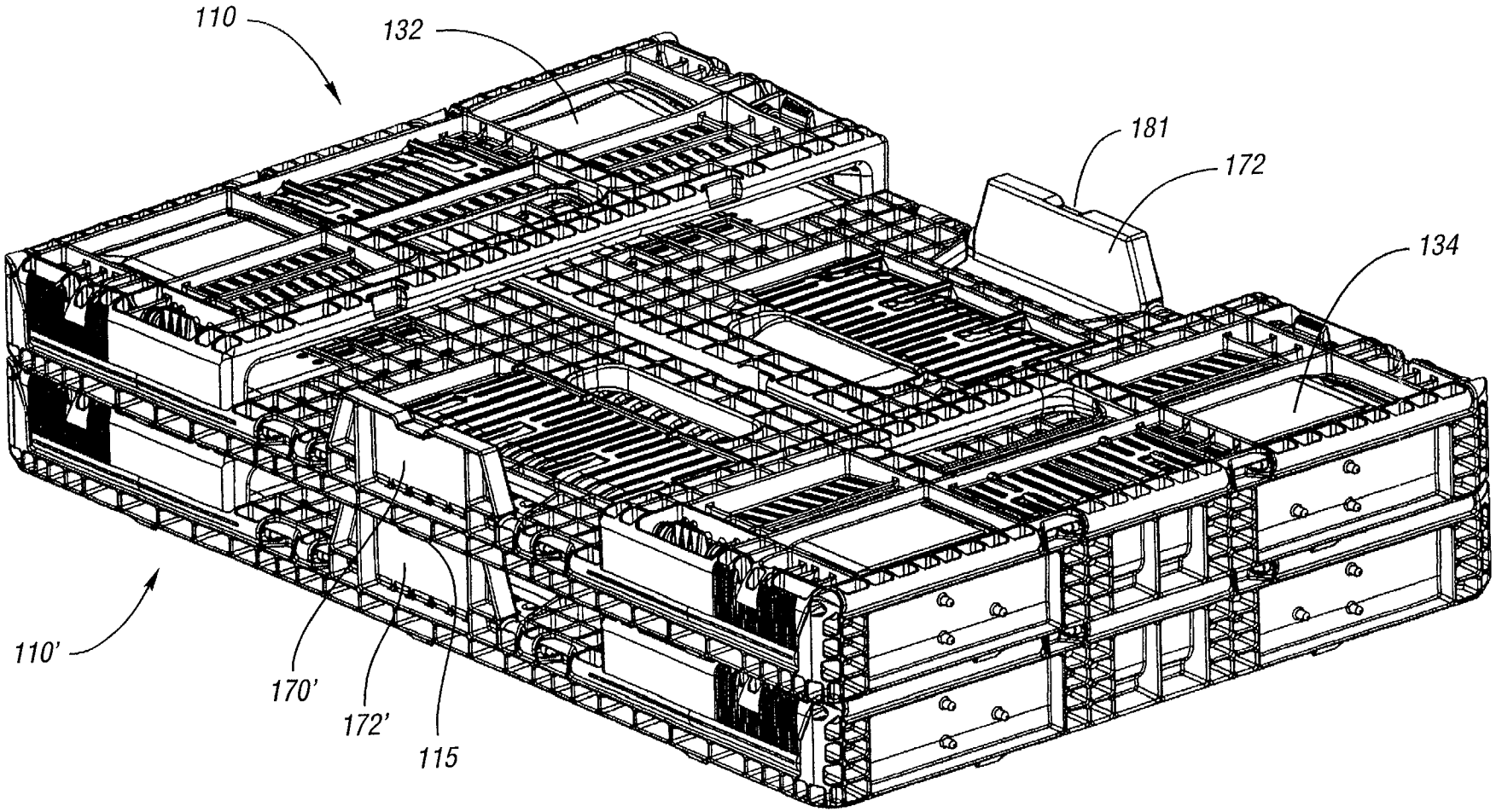
FIG. 32 illustrates a perspective view of the second embodiment shown in FIG. 31 nested on a like container.
Figure 33:
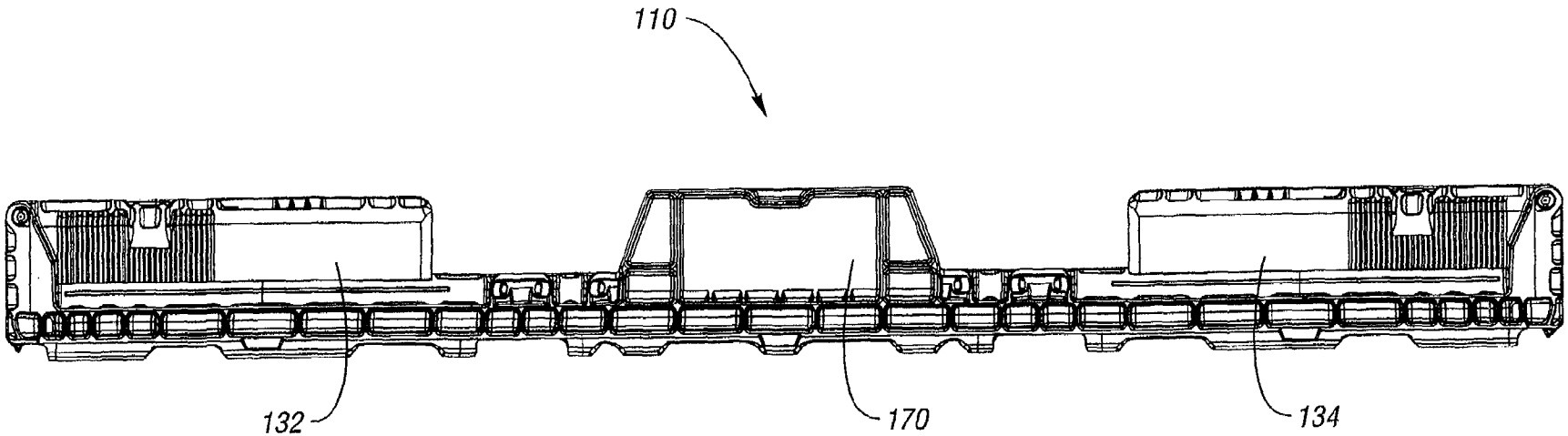
FIG. 33 illustrates a side elevational view of the inwardly collapsed container of FIG. 31.

FIG. 31 illustrates container 110 in an inwardly folded orientation. As FIGS. 31 and 32 indicate, the design according to the present invention allows container 110 to be compactly folded for storage and transport. In this orientation, side walls 128, 130 are pivoted inward via hinging mechanisms 180 and folded in a layered fashion on top of bottom panel 114. FIG. 32 illustrates that side walls 128 and 130 are folded first, and subsequently, end walls 132,134 are folded inward on top of side walls 128, 130 via hinging system 190. With reference to FIG. 32 and discussed further herein, container 10 may be nested securely with a similar container when in this inwardly folded orientation. For example, in this orientation, feet 115 shown on base 112 in FIG. 28 mates with notches 181, for example, disposed on members 170, 172. As previously mentioned, base 112 may have various designs which allow it to securely nest with a similar container 110' in the inwardly folded position as in FIG. 32, without departing from the teachings according to the present invention. FIG. 33 is a side elevational view of container 110 in the inwardly folded orientation of FIGS. 31–32.

Figure 34:
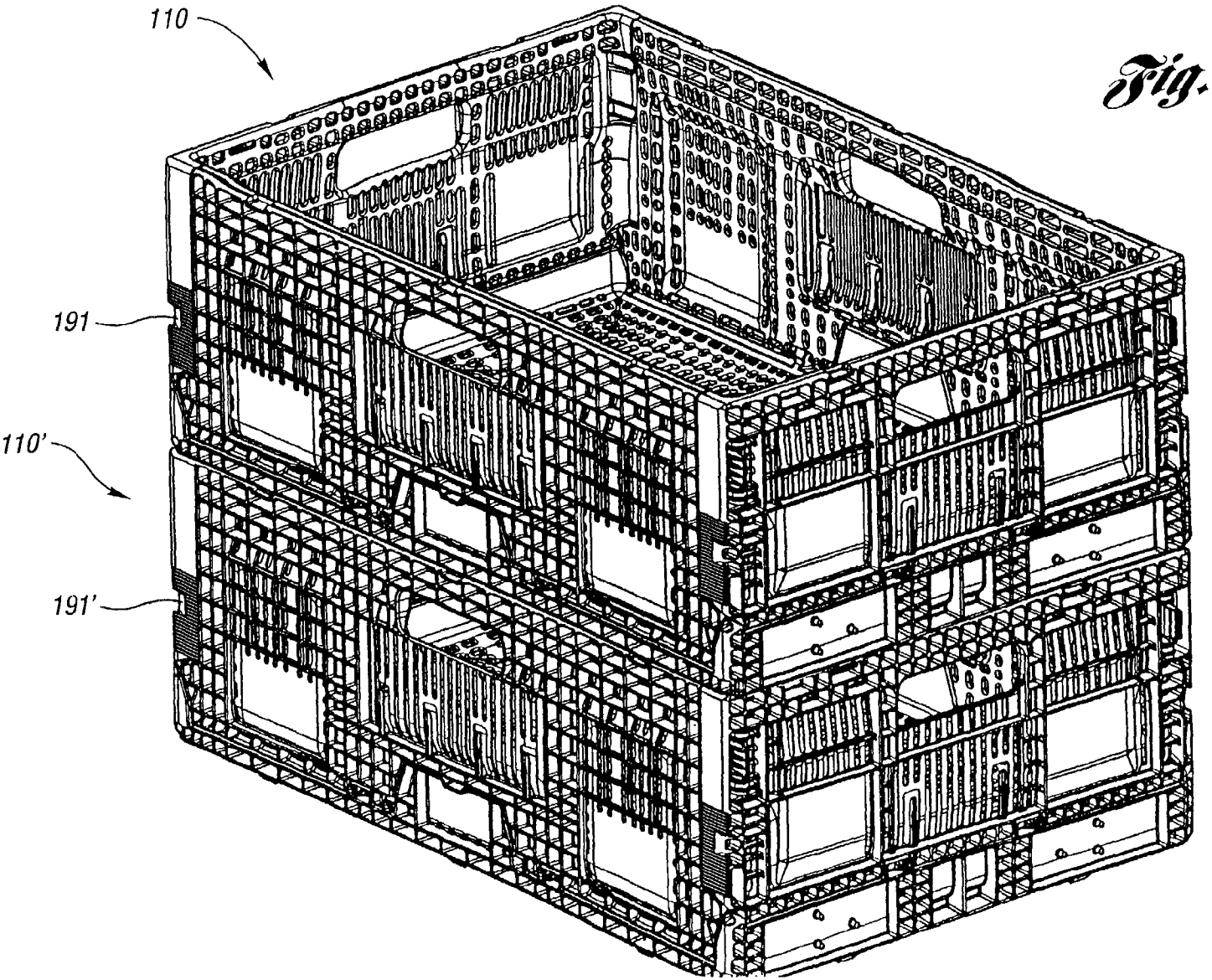
FIG. 34 illustrates a perspective view of the second embodiment of the container as shown in FIG. 25 in an assembled orientation, and stacked with a like container.

FIG. 34 is a perspective view of container 110 in an assembled and stacked orientation with a similar container 110'. As with the inwardly folded orientation, feet 115 of container 110 are received within corresponding recesses 117' formed in the upper edges of container 110'.

Figure 35:
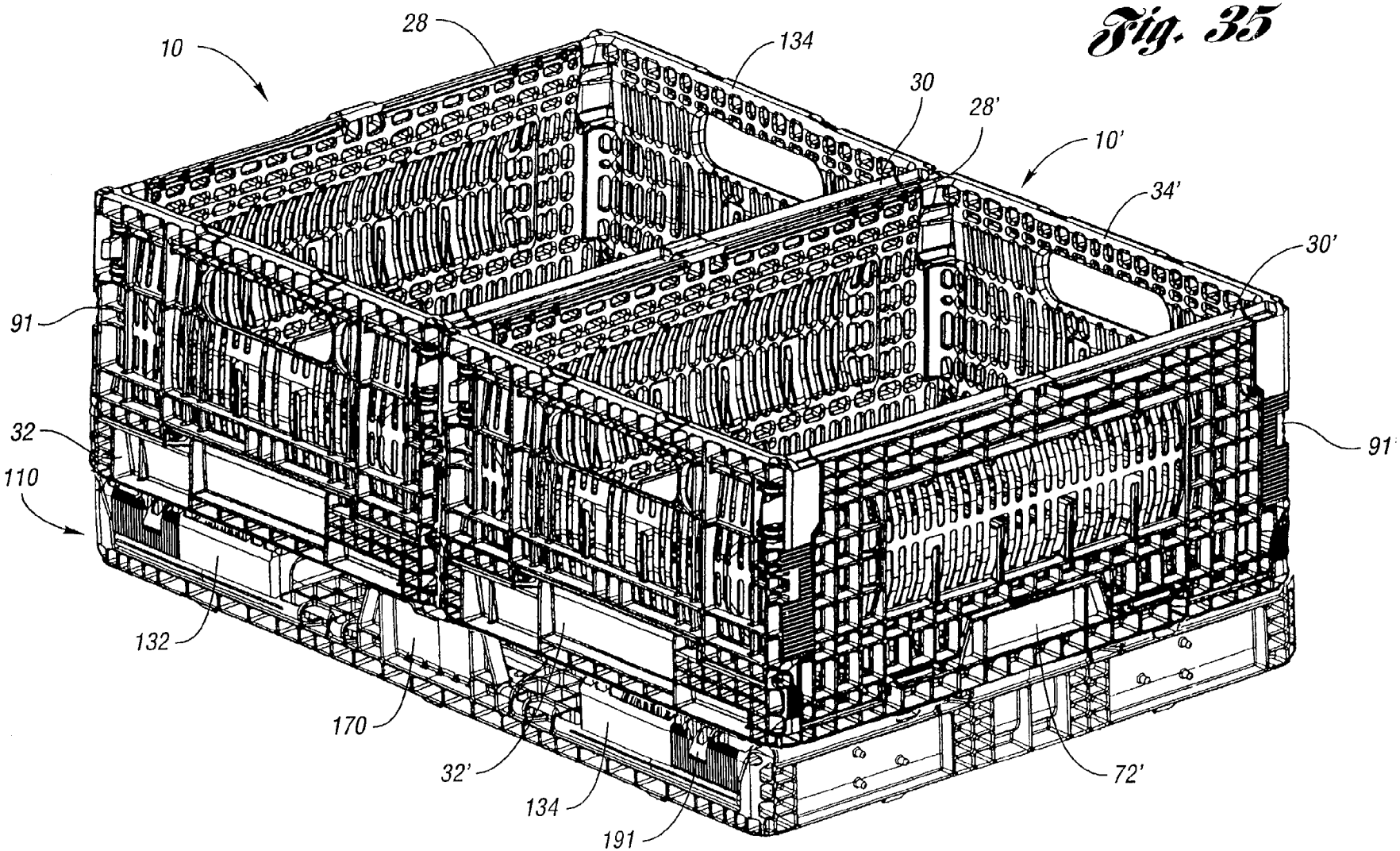
FIG. 35 illustrates a perspective view showing two containers according to the first embodiment positioned adjacent and stacked on the container according to the second embodiment.
Figure 36:
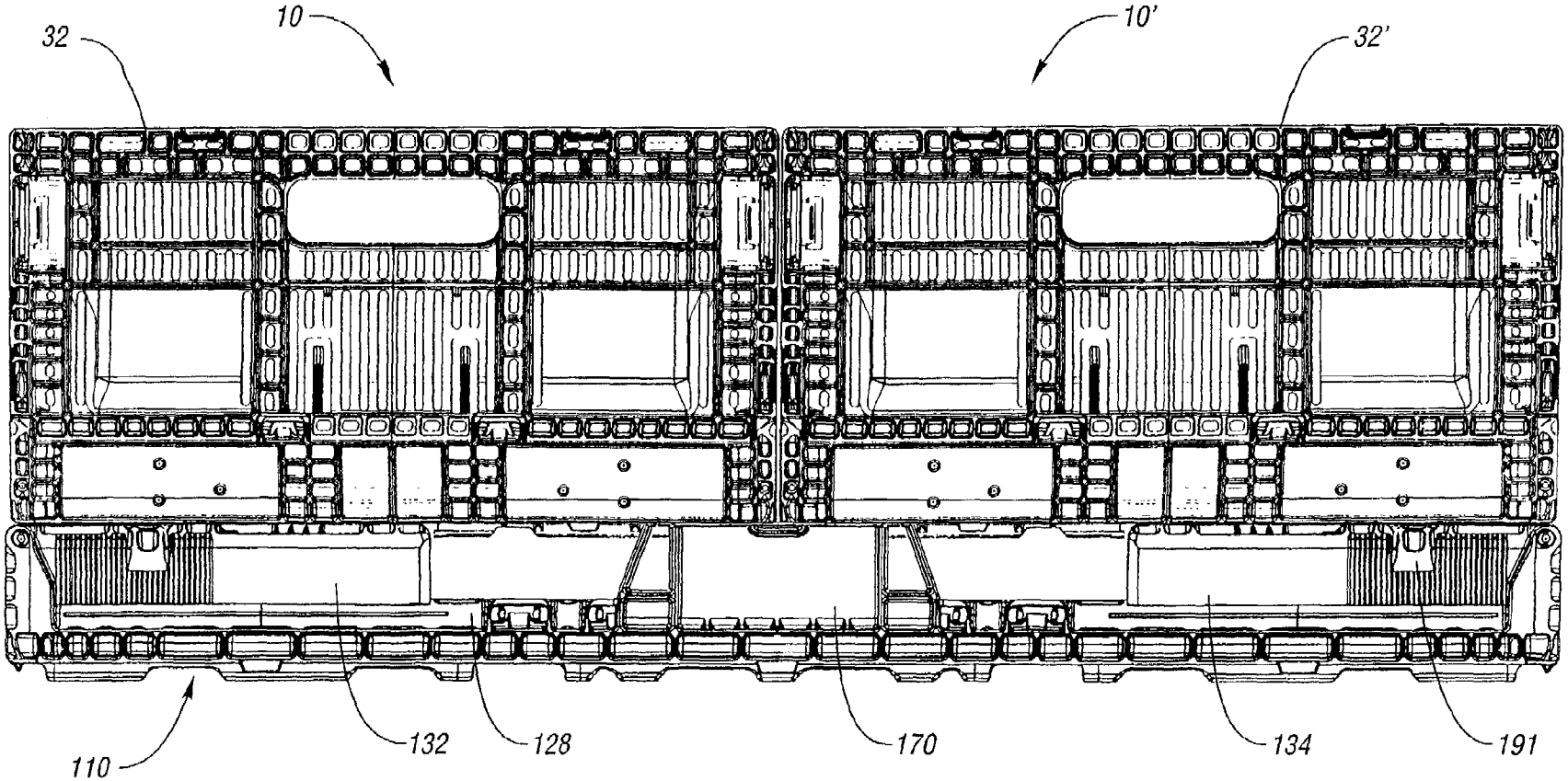
FIG. 36 is a side elevational view of the system shown in FIG. 35.

FIG. 35 illustrates a perspective view of a stacking system 200 showing two containers 10 according to the first embodiment positioned side-by-side with side wall 28 of one container adjacent side wall 30 of the other. Containers 10 are stacked on inwardly folded container 110 according to the second embodiment. FIG. 36 is a side elevational view of the system shown in FIG. 35. As illustrated, when container 110 is folded inwardly, opposed upstanding members 170, 172 provide support to the two upper containers 10 in the gap area between shorter end walls 132, 134, thus allowing the two containers 10 to be supported over a greater area, and thus providing a more durable stacking system 200. This is particularly true when the upper containers 10 are half-size containers as illustrated in FIGS. 35–36, and therefore have adjacent portions which meet centrally across container 110 and which would not be completely and fully supported without opposed upstanding members 170, 172. Note that the containers 10 in this stacking system 200 need not be one-half the size of the lower container 110 in order to achieve the objects according to the present invention, but may be another full size container 110. Further, while FIGS. 35–36 illustrate that upper containers 10 are in their assembled positions on container 110, upper containers 10 may also be inwardly collapsed as in FIG. 11 according to the teachings of the present invention. Such central support does not otherwise exist in the prior art in containers where the short walls are folded last.

Note that in accordance with the present invention, the features and components illustrated and disclosed in association with the first embodiment may equally apply to the second embodiment, and vice versa.

It is understood, of course, that while the forms of the invention herein shown and described include the best mode contemplated for carrying out the present invention, they are not intended to illustrate all possible forms thereof. It will also be understood that the words used are descriptive rather than limiting, and that various changes may be made without departing from the spirit or scope of the invention as claimed below.

What is claimed is:

1. A collapsible container, comprising:

a base having a first pair of opposed upstanding members and a second pair of opposed upstanding members extending upwardly from a bottom panel, the first and second pairs of opposed upstanding members each having an uppermost surface, the uppermost surfaces of the first and second pairs of opposed upstanding members generally disposed in a plane generally parallel to the bottom panel of the base; and a first pair of opposed side walls each pivotably attached to the base and orientable between an assembled position and a second position, each of the first pair of opposed side walls including a recess for mating with and receiving a corresponding one of the first pair of opposed upstanding members when in the assembled position; and a second pair of opposed side walls each pivotably attached to a corresponding one of the second pair of opposed upstanding members and orientable between an assembled position and a second position.

2. The container of claim 1, wherein the base includes at least one raised portion extending between the second pair of opposed side walls.

3. The container of claim 1, wherein the base further includes a plurality of upstanding corner members each having a recess formed therein, and wherein each of the first pair of opposed side walls has a lateral edge and a portion extending outwardly from the lateral edge and received within a corresponding recess of the upstanding corner members, for enhancing the strength of the container.

4. The container of claim 1, wherein one of the first and second pair of opposed side walls includes a plurality of recesses adapted to receive a palletizing strap therein.

5. The container of claim 1, wherein each of the first pair of opposed side walls includes a latch member disposed thereon for latching the first and second pairs of opposed side walls when oriented in the assembled position.

6. The container of claim 1, wherein each of the second pair of opposed side walls each includes a pair of opposed lateral flanges inwardly depending therefrom and integral therewith, each lateral flange having a latch receiver formed therein.

7. The container of claim 6, wherein in the assembled position and the second position, each lateral flange of the second pair of opposed side walls is substantially co-planar with the first pair of opposed upstanding members of the base.

8. The container of claim 6, wherein the latch receiver includes an aperture and a flexible latch spring member and having a latch release member actuable by a user.

9. The container of claim 8, wherein the first pair of opposed side walls includes a pair of opposed lateral edges, each lateral edge having a latching member attached thereto, wherein when the container is oriented in an assembled position, each lateral flange abuts an adjacent lateral edge so that each aperture receives a corresponding hitching member which is fastened into position by the latch spring member, thereby forming a secure attachment between the first and second pairs of opposed side walls, and wherein to return the container to a collapsed position from the assembled position, each latch release member is actuated by the user in order to release the latching member fastened therein.

10. The container of claim 1, wherein the base includes a first and second pair of opposed edges, the first pair of opposed side walls and the second pair of opposed side walls pivotably attached to a corresponding one of the first and second pair of opposed edges.

11. The container of claim 1, wherein the first and second pair of opposed side walls are oriented in the second position, they are oriented in one of an inwardly folded orientation and an outwardly folded orientation.

12. The collapsible container of claim 1, wherein the first pair of opposed upstanding members are centrally disposed along the length of the base.

13. The collapsible container of claim 1, wherein the first pair of opposed upstanding members have a trapezoidal shape.

14. The container of claim 1 wherein the first pair of opposed side walls are pivotably attached to the base by first hinges and wherein die second pair of opposed side walls are pivotably attached to the second pair of upstanding members by second hinges, wherein the second hinges are at a greater distance from the bottom panel of the base than the first hinges.

15. The container of claim 1 wherein the first pair of opposed side walls are pivotably attached to the base by first hinges and wherein the second pair of opposed side walls are pivotably attached to the second pair of upstanding members by second hinges, wherein the second pair of opposed side walls each include a pair of lateral flanges, the lateral flanges disposed on the first hinges when the first and second pairs of walls are in an inwardly-collapsed position.

16. The container of claim 1 wherein the plane generally containing the uppermost surfaces of the first and second pairs of opposed upstanding members is substantially co-planar with an uppermost surface of the second pair of opposed side walls when the second pair of opposed side walls are in an inwardly-collapsed position.

17. The container of claim 1 wherein the second pair of opposed side walls each include a pair of lateral flanges, each of the first upstanding members disposed between one of the Lateral flanges on each of the second pair of opposed side walls when the second pair of opposed side walls are in an inwardly-collapsed position.

18. A collapsible container orientable in an inwardly folded position and adapted to receive the base of a least one other container thereupon in a nesting orientation when the collapsible container is in the inwardly folded position, the collapsible container comprising:

a base having an upper surface and a pair of opposed upstanding members;

a first pair of opposed side walls each pivotably attached to the base by at least one hinge orientable in the inwardly folded position, the upstanding members extending upward from the base higher than the hinges; and a second pair of opposed side walls each pivotably attached to the base and orientable in the inwardly folded position for resting on the first pair of opposed side walls, the second pair of opposed side walls in the inwardly folded position being spaced apart with the pair of opposed upstanding members disposed therebetween, wherein the second pair of opposed side walls and an upper surface of the opposed upstanding members provide a stable surface for nesting the at least one other container thereupon.

19. The collapsible container of claim 18, wherein the pair of opposed upstanding members are centrally disposed along the length of the base.

20. The container of claim 18 having the at least one other container stacked thereon, the base of the at least one other container directly supported on the second pair of opposed side walls and the upper surface of the opposed upstanding members.

21. The container of claim 18 wherein the at least one hinge includes at least two hinges, each of the first pair of opposed side walls is pivotably attached to the base by the at least two hinges, and each upstanding member is between the at least two hinges.

22. The container of claim 21 wherein the first pair of side walls include openings adjacent the base into which the upstanding members are received upon pivoting the first pair of side walls to the upright position.

* * * * *

UNITED STATES PATENT AND TRADEMARK OFFICE

CERTIFICATE OF CORRECTION

PATENT NO. : 7,044,319 B2
APPLICATION NO. : 10/163004
DATED : May 16, 2006
INVENTOR(S) : Overholt et al.

It is certified that error appears in the above-identified patent and that said Letters Patent is hereby corrected as shown below:

Column 14, Claim 9, Line 39 of the issued patent, “hitching” should be --latching--.

Column 14, Claim 14, Line 63 of the issued patent, “die” should be --the--.

Column 15, Claim 17, Line 18 of the issued patent, “Lateral” should be --lateral--.

Column 15, Claim 18, Line 22 of the issued patent, “the” should be --a--.

Column 15, Claim 18, Line 29 of the issued patent, insert --and-- between “hinge” and “operable”.

Column 16, Claim 19, Line 15 of the issued patent, “the” should be --a--.

Signed and Sealed this

Twenty-second Day of August, 2006

JON W. DUDAS
*Director of the United States Patent and Trademark Office*